US007914373B2

(12) United States Patent
Webb et al.

(10) Patent No.: US 7,914,373 B2
(45) Date of Patent: Mar. 29, 2011

(54) GAMING DEVICE HAVING A GAME WITH A MOVING DIGIT GENERATED OUTCOME

(75) Inventors: Bayard S. Webb, Sparks, NV (US); Hans Elias, Reno, NV (US); Anthony J. Baerlocher, Reno, NV (US)

(73) Assignee: IGT, Reno, NV (US)

( * ) Notice: Subject to any disclaimer, the term of this patent is extended or adjusted under 35 U.S.C. 154(b) by 1601 days.

(21) Appl. No.: 11/222,914

(22) Filed: Sep. 9, 2005

(65) Prior Publication Data

US 2006/0025196 A1 Feb. 2, 2006

Related U.S. Application Data

(63) Continuation-in-part of application No. 10/660,281, filed on Sep. 10, 2003, now Pat. No. 7,547,252, which is a continuation-in-part of application No. 09/934,003, filed on Aug. 20, 2001, now Pat. No. 7,377,849.

(51) Int. Cl.
*A63F 9/24* (2006.01)

(52) U.S. Cl. ..... 463/22; 463/2

(58) Field of Classification Search ..... 463/22, 463/2

See application file for complete search history.

(56) References Cited

U.S. PATENT DOCUMENTS

| | | | |
|---|---|---|---|
| 2,743,108 | A | 4/1956 | Sanders |
| 3,618,952 | A | 11/1971 | Tallarida |
| 4,624,459 | A | 11/1986 | Kaufman |
| 4,669,731 | A | 6/1987 | Clarke |
| 4,695,053 | A | 9/1987 | Vazquez, Jr. et al. |
| 4,811,953 | A | 3/1989 | Jeng |
| 4,978,129 | A | 12/1990 | Komeda et al. |
| 4,991,848 | A | 2/1991 | Greenwood et al. |
| 5,116,055 | A | 5/1992 | Tracy |

(Continued)

FOREIGN PATENT DOCUMENTS

AU 97/39339 3/1998

(Continued)

OTHER PUBLICATIONS

A List of the Price is Right Pricing Games, http://en.wikipedia.org (website), printed on Aug. 8, 2007, available prior to Sep. 9, 2005.

(Continued)

*Primary Examiner* — Pierre E Elisca
(74) *Attorney, Agent, or Firm* — K&L Gates LLP

(57) ABSTRACT

A gaming device including a game having a plurality of selections. The player sequentially picks masked selections. The picked selections each yield a number or a terminator. If a number is revealed, the number is placed in a position or digit of an outcome or award. If the position is already occupied by another number, that other number is shifted, moved or slid to a new position. In one embodiment, the other number is shifted, moved or slid to the next highest order digit, for example, from the one's digit to the ten's digit. In this way, the player's outcome or award changes after each pick of a selection. If a number is in a last position, it is shifted off or removed from the positions. Eventually, the player picks a terminator and is provided an award that is based on the numbers in the positions, for example, the overall number made up of the constituent numbers and their associated digits.

34 Claims, 13 Drawing Sheets

U.S. PATENT DOCUMENTS 5,205,555 A 4/1993 Hamano
5,342,047 A 8/1994 Heidel et al.
5,344,144 A 9/1994 Canon
5,377,973 A 1/1995 Jones et al.
5,393,057 A 2/1995 Marnell, II
5,397,125 A 3/1995 Adams
5,456,465 A 10/1995 Durham
5,511,781 A 4/1996 Wood et al.
5,580,309 A 12/1996 Piechowiak et al.
5,584,764 A 12/1996 Inoue
5,611,535 A 3/1997 Tiberio
5,645,485 A 7/1997 Clapper, Jr.
5,700,009 A 12/1997 Meoni
5,722,891 A 3/1998 Inoue
5,769,716 A 6/1998 Saffari et al.
5,788,573 A 8/1998 Baerlocher et al.
5,816,918 A 10/1998 Kelly et al.
5,817,172 A 10/1998 Yamada et al.
5,823,873 A 10/1998 Moody
5,823,874 A 10/1998 Adams
5,823,879 A 10/1998 Goldberg et al.
5,833,536 A 11/1998 Davids et al.
5,848,932 A 12/1998 Adams
5,882,261 A 3/1999 Adams
5,910,048 A 6/1999 Feinberg
5,947,820 A 9/1999 Morro et al.
5,967,893 A 10/1999 Lawrence et al.
5,980,384 A 11/1999 Barrie
5,993,316 A 11/1999 Coyle et al.
5,997,401 A 12/1999 Crawford
6,004,207 A 12/1999 Wilson, Jr. et al.
6,012,982 A 1/2000 Piechowiak et al.
6,012,983 A 1/2000 Walker et al.
6,015,346 A 1/2000 Bennett
6,062,980 A 5/2000 Luciano
6,089,976 A 7/2000 Schneider et al.
6,102,400 A 8/2000 Scott et al.
6,102,798 A 8/2000 Bennett
6,109,610 A 8/2000 Cherry et al.
6,110,041 A 8/2000 Walker et al.
6,113,098 A 9/2000 Adams
6,120,031 A 9/2000 Adams
6,126,542 A 10/2000 Fier
6,142,873 A 11/2000 Weiss et al.
6,146,273 A 11/2000 Olsen
6,155,925 A 12/2000 Giobbi et al.
6,158,741 A 12/2000 Koelling
6,159,095 A 12/2000 Frohm et al.
6,159,097 A 12/2000 Gura
6,159,098 A 12/2000 Slomiany et al.
6,162,121 A 12/2000 Morro et al.
6,168,520 B1 1/2001 Baerlocher et al.
6,168,522 B1 1/2001 Walker et al.
6,168,523 B1 1/2001 Piechowiak et al.
6,173,955 B1 1/2001 Perrie et al.
6,174,233 B1 1/2001 Sunaga et al.
6,174,234 B1 1/2001 Seibert, Jr. et al.
6,174,235 B1 1/2001 Walker et al.
6,186,894 B1 2/2001 Mayeroff
6,190,255 B1 2/2001 Thomas et al.
6,203,429 B1 3/2001 Demar et al.
6,210,277 B1 4/2001 Stefan
6,210,279 B1 4/2001 Dickinson
6,217,022 B1 4/2001 Astaneha
6,224,482 B1 5/2001 Bennett
6,224,483 B1 5/2001 Mayeroff
6,227,969 B1 5/2001 Yoseloff
6,227,971 B1 5/2001 Weiss
6,231,442 B1 5/2001 Mayeroff
6,231,445 B1 5/2001 Acres
6,234,897 B1 5/2001 Frohm et al.
6,238,287 B1 5/2001 Komori et al.
6,244,957 B1 6/2001 Walker et al.
6,251,013 B1 6/2001 Bennett
6,254,482 B1 7/2001 Walker et al.
6,261,177 B1 7/2001 Bennett
6,270,409 B1 8/2001 Shuster
6,283,855 B1 9/2001 Bingham
6,299,165 B1 10/2001 Nagano
6,302,791 B1 10/2001 Frohm et al.
6,309,299 B1 10/2001 Weiss
6,309,300 B1 10/2001 Glavich
6,312,331 B1 11/2001 Tamaki
6,312,334 B1 11/2001 Yoseloff
6,315,662 B1 11/2001 Jorasch et al.
6,315,663 B1 11/2001 Sakamoto
6,322,309 B1 11/2001 Thomas et al.
6,328,649 B1 12/2001 Randall et al.
6,334,814 B1 1/2002 Adams
6,335,815 B1 1/2002 Kobayashi
6,336,862 B1 1/2002 Byrne
6,346,043 B1 2/2002 Colin et al.
6,347,996 B1 2/2002 Gilmore et al.
6,358,147 B1 3/2002 Jaffe et al.
6,364,767 B1 4/2002 Brossard et al.
6,394,902 B1 5/2002 Glavich et al.
6,398,201 B1 6/2002 Solomond et al.
6,398,218 B1 6/2002 Vancura
6,413,161 B1 7/2002 Baerlocher et al.
6,428,412 B1 8/2002 Anderson et al.
6,439,995 B1 8/2002 Hughs-Baird et al.
6,443,837 B1 9/2002 Jaffe et al.
6,514,141 B1 2/2003 Kaminkow et al.
6,565,436 B1 5/2003 Baerlocher
6,569,016 B1 5/2003 Baerlocher
6,575,830 B2 6/2003 Baerlocher et al.
6,582,306 B1 6/2003 Kaminkow
6,589,114 B2 7/2003 Rose
6,609,972 B2 8/2003 Seelig et al.
6,659,864 B2 12/2003 McGahn et al.
6,688,977 B1 2/2004 Baerlocher et al.
6,712,694 B1 3/2004 Nordman
6,722,981 B2 4/2004 Kaminkow et al.
6,722,982 B2 4/2004 Kaminkow et al.
6,776,711 B1 8/2004 Baerlocher
6,796,901 B2 9/2004 Baerlocher
6,811,483 B1 11/2004 Webb et al.
6,811,485 B2 11/2004 Kaminkow
6,875,108 B1 4/2005 Hughs-Baird
6,966,833 B2 11/2005 Kaminkow et al.
6,971,955 B2 12/2005 Baerlocher et al.
6,979,263 B2 12/2005 Baerlocher et al.
7,131,908 B2 11/2006 Baerlocher
7,172,506 B2 2/2007 Baerlocher et al.
7,566,271 B2 * 7/2009 Hostetler et al. ..... 463/25
2002/0094861 A1 7/2002 Seelig et al.
2003/0036422 A1 2/2003 Baerlocher et al.
2003/0162579 A1 8/2003 Gauselmann
2004/0053687 A1 3/2004 Nordman
2004/0214628 A1 10/2004 Boyd et al.
2005/0054416 A1 * 3/2005 Hostetler et al. ..... 463/16
2005/0164774 A1 7/2005 Gauselmann
2006/0025196 A1 * 2/2006 Webb et al. ..... 463/16
2006/0073872 A1 * 4/2006 B-Jensen et al. ..... 463/20
2008/0076535 A1 * 3/2008 Baerlocher et al. ..... 463/25
2008/0214272 A1 * 9/2008 Baerlocher et al. ..... 463/17

FOREIGN PATENT DOCUMENTS

AU 99/17318 9/1999
AU 200069612 10/2000
CA 2140949 10/1995
EP 0945837 A2 9/1999
EP 0984409 A2 3/2000
GB 2 366 435 6/2002
JP 7275432 10/1995
WO WO 85/00910 2/1985
WO WO 97/32285 9/1997
WO WO 98/09259 3/1998
WO WO 00/12186 3/2000
WO WO 00/17831 3/2000
WO WO 0119476 A1 3/2001
WO WO 0158546 A1 8/2001
WO WO 03/015881 2/2003
WO WO 03/015883 2/2003
WO WO 03/102885 12/2003

OTHER PUBLICATIONS

A Salute to Game Shows—The Price is Right—Pricing Games (website). Retrieved from the Internet on Aug. 8, 2007: http://benschumin.simplenet.com/game-shows/shows/price-is-right/pricing-games-2.htm, available prior to Sep. 9, 2005.
Any Number Game Description, (website), printed on Aug. 8, 2007, available prior to Sep. 9, 2005.
Office Action dated Oct. 17, 2002 for U.S. Appl. No. 09/934,003.
Office Action dated Feb. 4, 2003 for U.S. Appl. No. 09/933,843.
Office Action dated Jun. 26, 2003 for U.S. Appl. No. 09/934,003.
Office Action dated Jul. 30, 2003 for U.S. Appl. No. 09/933,843.
Office Action dated Jan. 2, 2004 for U.S. Appl. No. 09/934,003.
Office Action dated Oct. 4, 2004 for U.S. Appl. No. 09/934,003.
Office Action dated Nov. 4, 2004 for U.S. Appl. No. 10/160,687.
Office Action dated Oct. 17, 2005 for U.S. Appl. No. 10/160,687.
Office Action dated Nov. 9, 2005 for U.S. Appl. No. 09/934,003.
Office Action dated Feb. 15, 2006 for U.S. Appl. No. 09/933,843.
Office Action dated May 4, 2006 for U.S. Appl. No. 10/160,687.
Office Action dated Jun. 9, 2006 for U.S. Appl. No. 09/933,843.
Office Action dated Nov. 29, 2006 for U.S. Appl. No. 09/934,003.
Office Action dated Feb. 21, 2007 for U.S. Appl. No. 09/934,003.
Office Action dated Mar. 15, 2007 for U.S. Appl. No. 10/160,687.
Office Action dated Apr. 3, 2007 for U.S. Appl. No. 10/660,281.
Take Your Pick Game Brochure, written by IGT, published 1999.
The Price is Right Game Description, http://en.wikipedia.org (website), printed on Aug. 8, 2007, available prior to Sep. 9, 2005.
Three Strikes Game Description, http://en.wikipedia.org (website), printed on Aug. 7, 2007, available prior to Sep. 9, 2005.
A Salute to Game Shows—The Price is Right—Pricing Games (website). Retrieved from the Internet on Aug. 16, 2000: <http://benschumin.simplenet.com/game-shows/shows/price-is right/pricing-games.htm>.
Babooshka Advertisement in Gaming for Africa, written by Atronic, published in May 2002.
Black Swan Wagering Description and Paytable written by IGT, published prior to 2001.
By George Advertisement, written by IGT, published 2002.
Description of Let's Make a Deal Television Show written by www.ballygaming.com, printed Mar. 16, 2001.
Fey, Marshall, Slot machines—A Pictorial History of the First 100 Years, Liberty Bell Books, 5th Ed, 1997.
Fortune Cookie Brochure written by IGT, published 2000.
Free Fall Poker Descrption written by IGT, available prior to 2001.
Groundbreaking Mr. Cashman™ Latest Innovation Advertisement, written by International News, available prior to 2005.
Jackpot Party Brochure and Articles written by WMS Gaming, Inc, published in 1988.
Jazzy Jackpots Advertisement written by Atronic, published prior to 2001.
Jazzy Jackpots Article written by Strictly Slots, published Mar. 2001.
Jumble (website) written by WMS, printed Mar. 21, 2001.
Jumble Advertisement written by WMS Gaming Inc., published prior to 2000.
Jumble Article written by Strictly Slots published in Dec. 2000.
Loaded Dice Advertisement written by Konami Gaming, published in 2000.
Marketplace—Aristocrat Mr. Cashman Advertisement, p. 44, published Nov. 2002.
Montecasino Gets Mr. Cashman Article, written by Gaming for Africa, p. 10, available prior to 2005.
Mr. Cashman Advertisement, written by Reel Power, available prior to 2005.
Mr. Cashman article, written by Australian News, p. 37, available prior to 2005.
Neon Nights Advertisement written by IGT, published in 2000.
Price is Right "Bump" Description written by gscentral.net (web site), available 1986.
Price is Right "Coming or Going" Description written by gscentral.net (web site), available Oct. 2003.
Price is Right "Flip Flop" Description written by gscentral.net (web site), available Feb. 25, 2005.
Price is Right "Freeze Frame" Description written by gscentral.net (web site), available 1994.
Price is Right "Push Over" Description written by gscentral.net (web site), available 1999.
Price is Right "Side by Side" Description written by gscentral.net (web site), available 1995.
Price is Right "Squeeze Play" Description written by gscentral.net (web site), available 1977.
Rainbow Riches Five-Liner Advertisement, written by BSCI Corporation, published prior to Aug. 20, 2001.
Slot Machine Game With Roaming Wild Card, published prior to Aug. 20, 2001.
Sphinx Magic Advertisement, written by Atronic Casino Technology, Ltd., published 1997.
Tetris Game Description written by Radica, published in 2000.
Texas Tea Advertisement written by IGT, published in 2000.
Tokenization Description written by IGT, available prior to 2001.
Top Dollar Advertisement written by IGT, published in 1998.
Top Dollar Technical Brochure written by IGT, pp. 1-2, published in 1998.
Vision Bonus Games Advertisement includes "Diamond Fives Buy-A-Bonus Spin," written by IGT, published 1999.
Wheel of Fortune Brochure written by IGT published in 1998.
Who Dunnit Advertisement written by WMS Gaming, Inc., published Jun. 26, 2001.
Wild Streak Brochures written by WMS Gaming, Inc., published Mar. 2001.

* cited by examiner

GAMING DEVICE HAVING A GAME WITH A MOVING DIGIT GENERATED OUTCOME

PRIORITY CLAIM

This application is a continuation-in-part application of, claims priority to and the benefit of U.S. patent application Ser. No. 10/660,281, filed on Sep. 10, 2003, now U.S. Pat. No. 7,547,252 which is a continuation-in-part of and claims the benefit of U.S. patent application Ser. No. 09/934,003, filed Aug. 20, 2001, now U.S. Pat. No. 7,377,849 which are incorporated herein in their entirety.

CROSS-REFERENCE TO RELATED APPLICATIONS

This application relates to the following co-pending commonly owned patent applications: "Gaming Device Having a Bonus Scheme With Alternative Ending Sequences," Ser. No. 10/160,687; "Gaming Device Having Player Selectable Award Digits And Award Modification Options," Ser. No. 09/934,003; "Gaming Device having Player-Selectable Award Digits And Award Modification Options," Ser. No. 10/660,281; and "Gaming Device Having Award Modification Options For Player Selectable Award Digits," Ser. No. 11/626,632.

BACKGROUND

The present disclosure relates to a gaming device having a game with a moving digit outcome.

Gaming devices provide enjoyment and excitement to players, in part, because they may ultimately lead to monetary awards for the players. Gaming devices also provide enjoyment and excitement to players because they are fun to play. Bonus games, in particular, provide gaming device manufacturers with the opportunity to add enjoyment and excitement to that which is already expected from a base game of the gaming device. Bonus games provide extra awards to the player and enable the player to play a game that is different than the base game.

Gaming devices are typically games of luck, not skill. They are configured to pay back on average a certain percentage of the amount of money wagered. The average payout percentage in most wagering games is set high enough that any player who plays a few hands or spins of the reels obtains one or more winning outcomes. That is, in most wagering games it is not too difficult to experience some level of success.

Bonus games are typically configured for the player to succeed and are factored into the overall paytable of the wagering game accordingly. The player usually wins an award in a bonus game. In bonus game play, the goal is often to maximize the possible award. Winning, at least on some level, is therefore a standard component in gaming devices.

A continuing need therefore exists to provide gaming devices that issue awards in different manners which are exciting and enjoyable manner. In that respect, it is desirable to enable the player to have an impact on, or a hand in, determining their award. It is further desirable to have an increased level of player interaction. Furthermore, it is desirable to build suspense during a player interactive game, for example, to provide a game in which the player wishes for a certain result while interacting with the game.

Each of the above features is desirable in a primary or base wagering game or a secondary or bonus game. Accordingly, a need exists for the further development of games having the above-described features and advantages.

SUMMARY

The present disclosure provides a game that can be played as a stand-alone wagering game or as a bonus game. In one embodiment, the game includes a plurality of masked selections and enables the player to sequentially pick a plurality of these masked selections. The picked selections each yield a number or a terminator. If a number is revealed, the number is placed in a position or digit of an outcome or award. If the position is already occupied by another number, that number is moved to or slid to a new position. In one embodiment, that number is slid or shifted to the next highest order digit, for example, from the one's digit to the ten's digit. In this way, the player's outcome or award changes after each pick of a selection until a terminator is selected. Eventually, the player picks a terminator and is provided an award that is based on the numbers or order of the numbers in the positions. In one example, the outcome or award is an overall amount formed by the constituent numbers and their associated digits, places or positions.

In one embodiment, two positions or digits are provided and the digit area is initially unoccupied. If the player picks a first selection that reveals a number, that first number is placed in the one's digit place or position. If the player picks a second selection that reveals a number, that second number is placed in the one's digit place or position and the first number is moved, slid or shifted to the ten's digit place. If the player picks a third selection that reveals a number, that third number is placed in the one's digit place or position, the first number is moved, slid or shifted to the one hundred's digit place and the second number is moved, slid or shifted to the ten's digit place. If the player picks a fourth selection that reveals a number, that fourth number is placed in the one's digit place or position, the second number is moved, slid or shifted to the one hundred's digit place and the third number is moved, slid or shifted to the ten's digit place. The first number is shifted or moved off of or eliminated from the positions or digits. While three digit places or positions provides an entertaining and manageable game, the present disclosure is expressly not limited to three digit places and can instead employ any suitable number of digit places.

When the player ultimately picks a terminator, the player is provided an award or outcome based on the numbers or order of numbers remaining or residing currently in the positions or digit places. In one embodiment, the award or outcome is or is determined by the ordered numbers in the positions or digit places. For example, if the number five is in the one hundred's digit place, the number three is in the ten's digit place and the number nine is in the one's digit place, the player's award or outcome is 539. In alternative embodiments, the number 539 is further modified such as multiplied by a multiplier, before it is provided to the player.

In an alternative embodiment, the numbers are not automatically placed in the one's digit place. The numbers may alternatively be placed in a higher order digit place. To that end, the numbers may be displayed with or otherwise associated with a directional indicator that indicates the direction of the movement or shifting of the numbers residing currently in the positions. For example, a number may be displayed in association with a right facing arrow, which indicates that the number is to be placed in one of the positions so as to displace a current number or numbers to the right. If the three positions of a three digit number are filled currently, the right facing arrow number is placed in the one hundred's digit place and the other numbers are each shifted to the right, decreasing by an order. Here, the one's digit place is moved off of the positions.

The game in an embodiment provides a consolation award in a situation where the player chooses a terminator early in the game such as on the first or second selections. The consolation can be of any suitable type, such as a multiplier, a number of credits, a retry or redo, a non-monetary award, a number of base game plays or spins (if the present game is a bonus game) and the like. It should also be appreciated that the gaming device may pick or provide one, more or all of the numbers.

In another embodiment, the gaming device includes a plurality levels wherein each level includes a multi-digit number. In one embodiment, a number that is eliminated from a multi-digit number of one level may be added to another multi-digit number of another level. In another embodiment, the gaming device enables a player to lock one or more numbers into a digit place for each of the multi-digit numbers for each a plurality of different levels.

When the game ends, the gaming device provides the player the determined award or outcome. If the game of the present disclosure is employed as a base or stand-alone game, the player has the opportunity to place another wager and play the game again. If the game of the present disclosure is employed as a bonus game of a stand-alone game, the player returns to and can thereafter continue to play the base game.

It is therefore an advantage of the present disclosure to provide a fun and exciting bonus game for a base game such as slot, poker, keno or other type of wagering games.

Another advantage of the present disclosure is to provide a bonus game having a fun and exciting display.

A further advantage of the present disclosure is to provide a game having multiple player inputs.

Another advantage of the present disclosure is to provide a game in which the player can hope to receive a terminator at one or more points during the game.

A further advantage of the present disclosure is to provide a game having an outcome determined by sliding or shifting digits.

Further still, it is an advantage of the present disclosure is to provide a wagering game in which the player may root for different results at different points or times in the game.

A further advantage of the present disclosure to provide a game that is relatively easy to understand and visualize.

Additional features and advantages of the present disclosure are described in, and will be apparent from, the following Detailed Description and the figures.

DETAILED DESCRIPTION

Figure 1A:
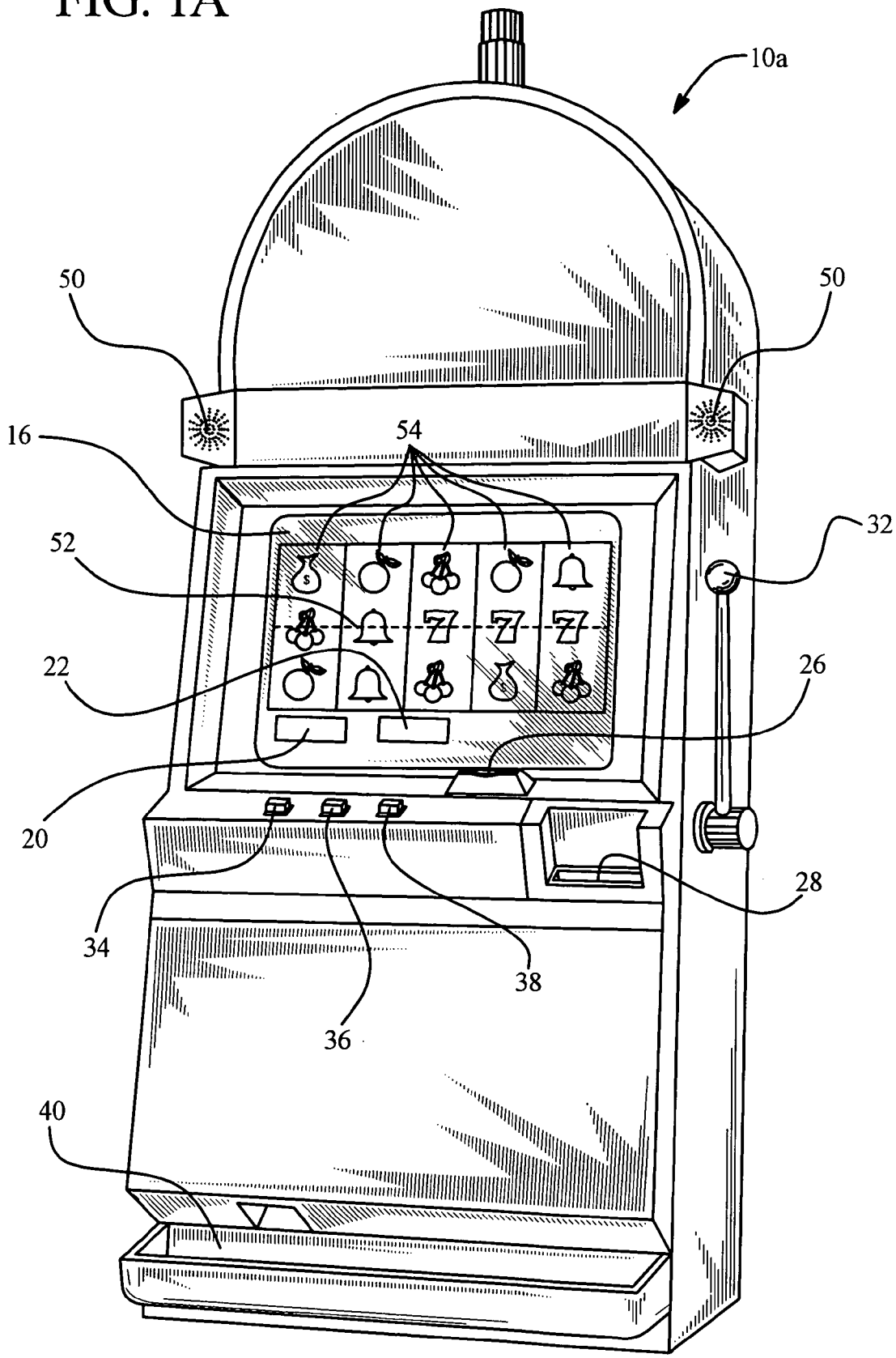
FIG. 1A is a front perspective view of one embodiment of the gaming device disclosed herein.
Figure 1B:
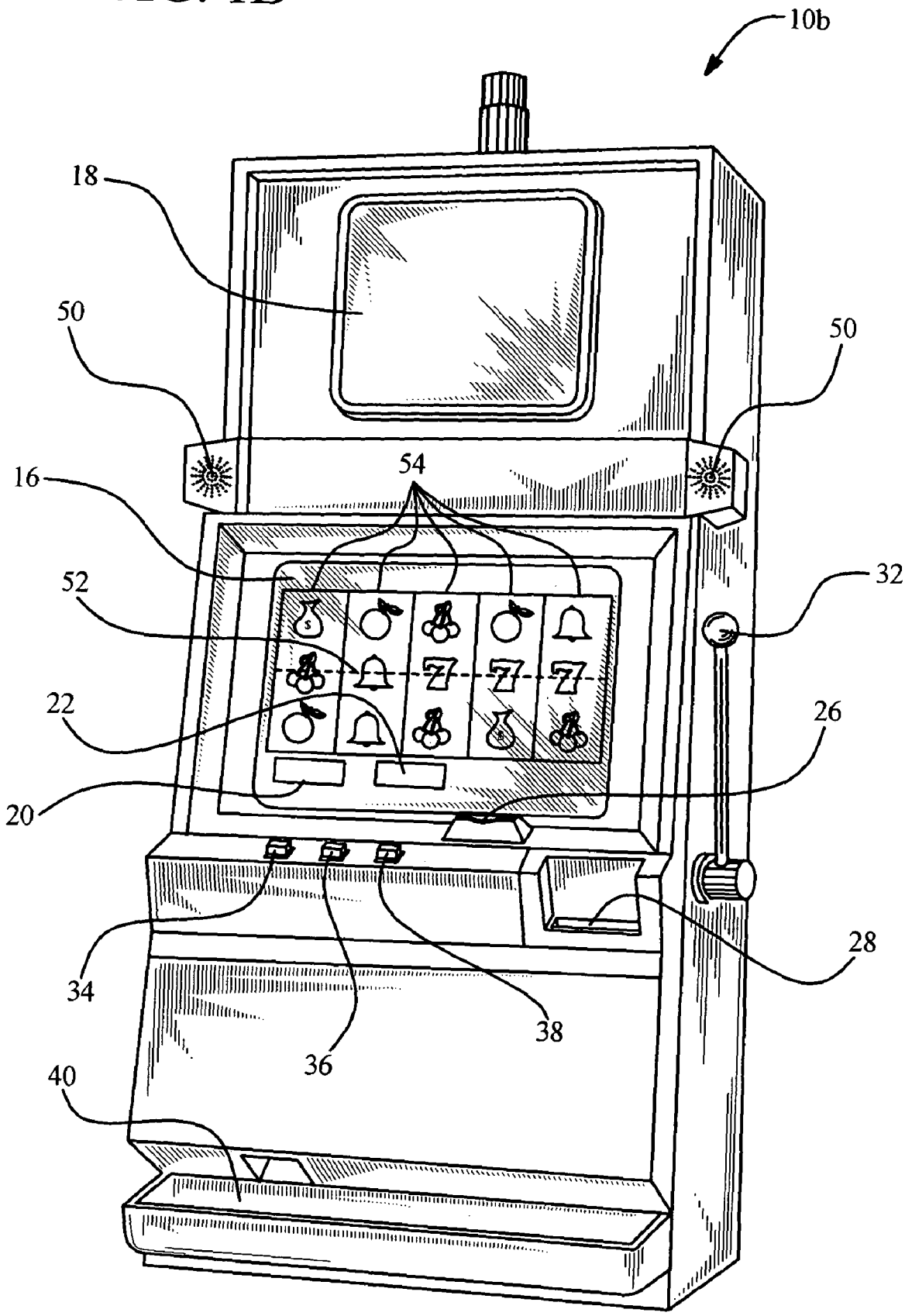
FIG. 1B is a front perspective view of another embodiment of the gaming device disclosed herein.

Referring now to the drawings, two alternative embodiments of the gaming device are illustrated in FIGS. 1A and 1B as gaming device 10*a* and gaming device 10*b*, respectively. Gaming device 10*a* and/or gaming device 10*b* are generally referred to herein as gaming device 10.

In one embodiment, as illustrated in FIGS. 1A and 1B, gaming device 10 has a support structure, housing or cabinet which provides support for a plurality of displays, inputs, controls and other features of a conventional gaming machine. It is configured so that a player can operate it while standing or sitting. The gaming device may be positioned on a base or stand or can be configured as a pub-style table-top game (not shown) which a player can operate preferably while sitting. As illustrated by the different configurations shown in FIGS. 1A and 1B, the gaming device may have varying cabinet and display configurations.

Figure 2A:
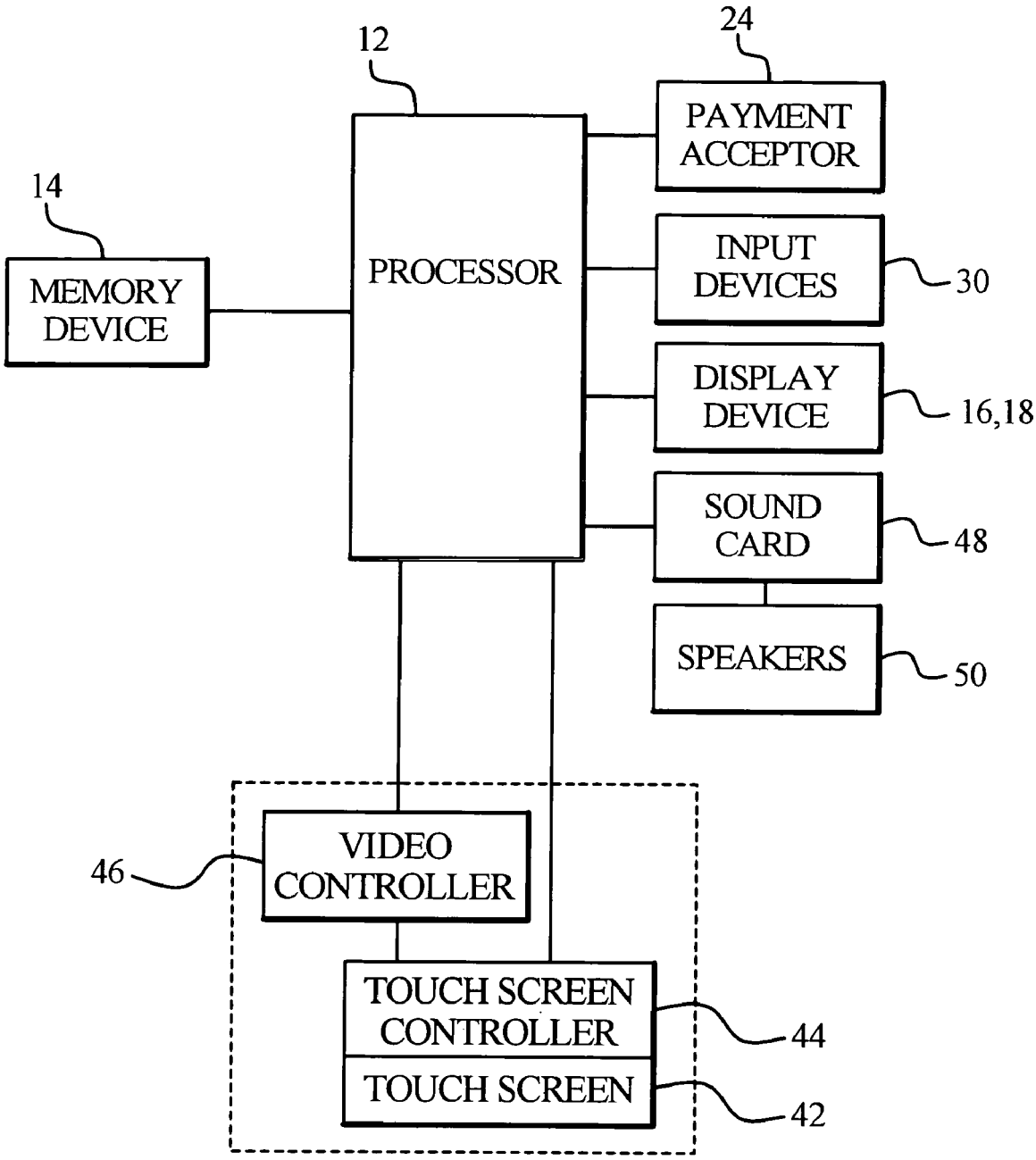
FIG. 2A is a schematic block diagram of one embodiment of an electronic configuration for one of the gaming devices disclosed herein.

In one embodiment, as illustrated in FIG. 2A, the gaming device preferably includes at least one processor 12, such as a microprocessor, a microcontroller-based platform, a suitable integrated circuit or one or more application-specific integrated circuits (ASIC's). The processor is in communication with or operable to access or to exchange signals with at least one data storage or memory device 14. In one embodiment, the processor and the memory device reside within the cabinet of the gaming device. The memory device stores program code and instructions, executable by the processor, to control the gaming device. The memory device also stores other data such as image data, event data, player input data, random or pseudo-random number generators, pay-table data or information and applicable game rules that relate to the play of the gaming device. In one embodiment, the memory device includes random access memory (RAM), which can include non-volatile RAM (NVRAM), magnetic RAM (MRAM), ferroelectric RAM (FeRAM) and other forms as commonly understood in the art. In one embodiment, the memory device includes read only memory (ROM). In one embodiment, the memory device includes flash memory and/or EEPROM (electrically erasable programmable read only memory). Any other suitable magnetic, optical and/or semiconductor memory may operate in conjunction with the gaming device disclosed herein.

In one embodiment, part or all of the program code and/or operating data described above can be stored in a detachable or removable memory device, including, but not limited to, a suitable cartridge, disk, CD ROM, DVD or USB memory device. A player can use such a removable memory device in a desktop, a laptop personal computer, a personal digital assistant (PDA) or other computerized platform. The processor and memory device may be collectively referred to herein as a "computer" or "controller."

In one embodiment, as discussed in more detail below, the gaming device randomly generates awards and/or other game outcomes based on probability data. That is, each award or other game outcome is associated with a probability and the gaming device generates the award or other game outcome to be provided to the player based on the associated probabilities. In this embodiment, since the gaming device generates outcomes randomly or based upon a probability calculation, there is no certainty that the gaming device will ever provide the player with any specific award or other game outcome. Such random determination could be provided through utilization of a random number generator (RNG) or other suitable randomization process.

In another embodiment, as discussed in more detail below, the gaming device employs a predetermined or finite set or pool of awards or other game outcomes. In this embodiment, as each award or other game outcome is provided to the player, the gaming device removes the provided award or other game outcome from the predetermined set or pool. Once removed from the set or pool, the specific provided award or other game outcome cannot be provided to the player again. This type of gaming device provides players with all of the available awards or other game outcomes over the course of the play cycle and guarantees the amount of actual wins and losses. In another embodiment, upon a player initiating game play at the gaming device, the gaming device enrolls in a bingo game. In this embodiment, a bingo server calls the bingo balls that result in a specific game outcome. The resultant game outcome is communicated to the individual gaming device to be provided to a player.

In one embodiment, as illustrated in FIG. 2A, the gaming device includes one or more display devices controlled by the processor. The display devices are preferably connected to or mounted to the cabinet of the gaming device. The embodiment shown in FIG. 1A includes a central display device 16 which displays a primary game. This display device may also display any secondary game associated with the primary game as well as information relating to the primary or secondary game. The alternative embodiment shown in FIG. 1B includes a central display device 16 and an upper display device 18. The upper display device may display the primary game, any suitable secondary game associated with the primary game and/or information relating to the primary or secondary game. In another embodiment, at least one display device may be a mobile display device, such as a PDA or tablet PC, that enables play of at least a portion of the primary or secondary game at a location remote from the gaming device. As seen in FIGS. 1A and 1B, in one embodiment, the gaming device includes a credit display 20 which displays a player's current number of credits, cash, account balance or the equivalent. In one embodiment, gaming device includes a bet display 22 which displays a player's amount wagered.

The display devices may include, without limitation, a monitor, a television display, a plasma display, a liquid crystal display (LCD) a display based on light emitting diodes (LED), a display based on a plurality of organic light-emitting diodes (OLEDs), a display based on polymer light-emitting diodes (PLEDs), a display including a projected and/or reflected image or any other suitable electronic device or display mechanism. In one embodiment, as described in more detail below, the display device includes a touch-screen with an associated touch-screen controller. The display devices may be of any suitable configuration, such as a square, a rectangle or an elongated rectangle.

The display devices of the gaming device are configured to display at least one and preferably a plurality of game or other suitable images, symbols and indicia such as any visual representation or exhibition of the movement of objects such as mechanical, virtual or video reels and wheels, dynamic lighting, video images, images of people, characters, places, things and faces of cards, tournament advertisements and the like.

In one alternative embodiment, the symbols, images and indicia displayed on or of the display device may be in mechanical form. That is, the display device may include any electromechanical device, such as one or more mechanical objects, such as one or more rotatable wheels, reels or dice, configured to display at least one and preferably a plurality of game or other suitable images, symbols or indicia.

As illustrated in FIG. 2A, in one embodiment, the gaming device includes at least one payment acceptor 24 in communication with the processor. As seen in FIGS. 1A and 1B, the payment acceptor may include a coin slot 26 and a payment, note or bill acceptor 28, where the player inserts money, coins or tokens. The player can place coins in the coin slot or paper money, ticket or voucher into the payment, note or bill acceptor. In other embodiments, devices such as readers or validators for credit cards, debit cards or credit slips may accept payment. In one embodiment, a player may insert an identification card into a card reader of the gaming device. In one embodiment, the identification card is a smart card having a programmed microchip or a magnetic strip coded with a player's identification, credit totals and other relevant information. In one embodiment, money may be transferred to a gaming device through electronic funds transfer. When a player funds the gaming device, the processor determines the amount of funds entered and displays the corresponding amount on the credit or other suitable display as described above.

As seen in FIGS. 1A, 1B and 2A, in one embodiment the gaming device includes at least one and preferably a plurality of input devices 30 in communication with the processor. The input devices can include any suitable device which enables the player to produce an input signal which is read by the processor. In one embodiment, after appropriate funding of the gaming device, the input device is a game activation device, such as a pull arm 32 or a play button 34 which is used by the player to start any primary game or sequence of events in the gaming device. The play button can be any suitable play activator such as a bet one button, a max bet button or a repeat the bet button. In one embodiment, upon appropriate funding, the gaming device begins the game play automatically. In another embodiment, upon the player engaging one of the play buttons, the gaming device automatically activates game play.

In one embodiment, as shown in FIGS. 1A and 1B, one input device is a bet one button 36. The player places a bet by pushing the bet one button. The player can increase the bet by one credit each time the player pushes the bet one button. When the player pushes the bet one button, the number of credits shown in the credit display preferably decreases by one, and the number of credits shown in the bet display preferably increases by one. In another embodiment, one input device is a bet max button (not shown) which enables the player to bet the maximum wager permitted for a game of the gaming device.

In one embodiment, one input device is a cash out button 38. The player may push the cash out button and cash out to receive a cash payment or other suitable form of payment corresponding to the number of remaining credits. In one embodiment, when the player cashes out, the player receives the coins or tokens in a coin payout tray 40. In one embodiment, when the player cashes out, the player may receive other payout mechanisms such as tickets or credit slips redeemable by a cashier or funding to the player's electronically recordable identification card.

In one embodiment, as mentioned above and seen in FIG. 2A, one input device is a touch-screen 42 coupled with a touch-screen controller 44, or some other touch-sensitive display overlay to allow for player interaction with the images on the display. The touch-screen and the touch-screen controller are connected to a video controller 46. A player can make decisions and input signals into the gaming device by touching the touch-screen at the appropriate places.

The gaming device may further include a plurality of communication ports for enabling communication of the processor with external peripherals, such as external video sources, expansion buses, game or other displays, an SCSI port or a key pad.

In one embodiment, as seen in FIG. 2A, the gaming device includes a sound generating device controlled by one or more sounds cards 48 which function in conjunction with the processor. In one embodiment, the sound generating device includes at least one and preferably a plurality of speakers 50 or other sound generating hardware and/or software for generating sounds, such as playing music for the primary and/or secondary game or for other modes of the gaming device, such as an attract mode. In one embodiment, the gaming device provides dynamic sounds coupled with attractive multimedia images displayed on one or more of the display devices to provide an audio-visual representation or to otherwise display full-motion video with sound to attract players to the gaming device. During idle periods, the gaming device may display a sequence of audio and/or visual attraction messages to attract potential players to the gaming device. The videos may also be customized for or to provide any appropriate information.

In one embodiment, the gaming machine may include a sensor, such as a camera in communication with the processor (and possibly controlled by the processor) that is selectively positioned to acquire an image of a player actively using the gaming device and/or the surrounding area of the gaming device. In one embodiment, the camera may be configured to selectively acquire still or moving (e.g., video) images and may be configured to acquire the images in either an analog, digital or other suitable format. The display devices may be configured to display the image acquired by the camera as well as display the visible manifestation of the game in split screen or picture-in-picture fashion. For example, the camera may acquire an image of the player and the processor may incorporate that image into the primary and/or secondary game as a game image, symbol or indicia.

Gaming device 10 can incorporate any suitable wagering primary or base game. The gaming machine or device may include some or all of the features of conventional gaming machines or devices. The primary or base game may comprise any suitable reel-type game, card game, number game or other game of chance susceptible to representation in an electronic or electromechanical form which produces a random outcome based on probability data upon activation from a wager. That is, different primary wagering games, such as video poker games, video blackjack games, video Keno, video bingo or any other suitable primary or base game may be implemented.

In one embodiment, as illustrated in FIGS. 1A and 1B, a base or primary game may be a slot game with one or more paylines 52. The paylines may be horizontal, vertical, circular, diagonal, angled or any combination thereof. In this embodiment, the gaming device displays at least one and preferably a plurality of reels 54, such as three to five reels 54 in either electromechanical form with mechanical rotating reels or video form with simulated reels and movement thereof. In one embodiment, an electromechanical slot machine includes a plurality of adjacent, rotatable wheels which may be combined and operably coupled with an electronic display of any suitable type. In another embodiment, if the reels 54 are in video form, one or more of the display devices, as described above, display the plurality of simulated video reels 54. Each reel 54 displays a plurality of indicia such as bells, hearts, fruits, numbers, letters, bars or other images which preferably correspond to a theme associated with the gaming device. In this embodiment, the gaming device awards prizes when the reels of the primary game stop spinning if specified types and/or configurations of indicia or symbols occur on an active payline or otherwise occur in a winning pattern, occur on the requisite number of adjacent reels and/or occur in a scatter pay arrangement.

In one embodiment, a base or primary game may be a poker game wherein the gaming device enables the player to play a conventional game of video poker and initially deals five cards all face up from a virtual deck of fifty-two card deck. Cards may be dealt as in a traditional game of cards or in the case of the gaming device, may also include that the cards are randomly selected from a predetermined number of cards. If the player wishes to draw, the player selects the cards to hold via one or more input device, such as pressing related hold buttons or via the touch screen. The player then presses the deal button and the unwanted or discarded cards are removed from the display and the gaming machine deals the replacement cards from the remaining cards in the deck. This results in a final five-card hand. The gaming device compares the final five-card hand to a payout table which utilizes conventional poker hand rankings to determine the winning hands. The gaming device provides the player with an award based on a winning hand and the credits the player wagered.

In another embodiment, the base or primary game may be a multi-hand version of video poker. In this embodiment, the gaming device deals the player at least two hands of cards. In one such embodiment, the cards are the same cards. In one embodiment each hand of cards is associated with its own deck of cards. The player chooses the cards to hold in a primary hand. The held cards in the primary hand are also held in the other hands of cards. The remaining non-held cards are removed from each hand displayed and for each hand replacement cards are randomly dealt into that hand. Since the replacement cards are randomly dealt independently for each hand, the replacement cards for each hand will usually be different. The poker hand rankings are then determined hand by hand and awards are provided to the player.

In one embodiment, a base or primary game may be a keno game wherein the gaming device displays a plurality of selectable indicia or numbers on at least one of the display devices. In this embodiment, the player selects at least one and preferable a plurality of the selectable indicia or numbers via an input device or via the touch screen. The gaming device then displays a series of drawn numbers to determine an amount of matches, if any, between the player's selected numbers and the gaming device's drawn numbers. The player is provided an award based on the amount of matches, if any, based on the amount of determined matches.

In one embodiment, in addition to winning credits in a base or primary game, the gaming device may also give players the opportunity to win credits in a bonus or secondary game or bonus or secondary round. The bonus or secondary game enables the player to obtain a prize or payout in addition to the prize or payout, if any, obtained from the base or primary game. In general, a bonus or secondary game produces a significantly higher level of player excitement than the base or primary game because it provides a greater expectation of winning than the base or primary game and is accompanied with more attractive or unusual features than the base or primary game.

In one embodiment, the bonus or secondary game may be any type of suitable game, either similar to or completely different from the base or primary game. In one embodiment, the gaming device includes a program which will automatically begin a bonus round when the player has achieved a triggering event or qualifying condition in the base or primary game. In one embodiment, the triggering event or qualifying condition may be a selected outcome in the primary game or a particular arrangement of one or more indicia on a display device in the primary game, such as the number seven appearing on three adjacent reels along a payline in the primary slot game embodiment seen in FIGS. 1A and 1B. In another embodiment, the triggering event or qualifying condition may be by exceeding a certain amount of game play (number of games, number of credits, amount of time), reaching a specified number of points earned during game play or as a random award.

In one embodiment, once a player has qualified for a bonus game, the player may subsequently enhance his/her bonus game participation through continued play on the base or primary game. Thus, for each bonus qualifying event, such as a bonus symbol, that the player obtains, a given number of bonus game wagering points or credits may be accumulated in a "bonus meter" programmed to accrue the bonus wagering credits or entries toward eventual participation in a bonus game. The occurrence of multiple such bonus qualifying events in the primary game may result in an arithmetic or geometric increase in the number of bonus wagering credits awarded. In one embodiment, the player may redeem extra bonus wagering credits during the bonus game to extend play of the bonus game.

In one embodiment, no separate entry fee or buy in for a bonus game need be employed. That is, a player may not purchase an entry into a bonus game, rather they must win or earn entry through play of the primary game thus, encouraging play of the primary game. In another embodiment, qualification of the bonus or secondary game could be accomplished through a simple "buy in" by the player if, for example, the player has been unsuccessful at qualifying through other specified activities.

Figure 2B:
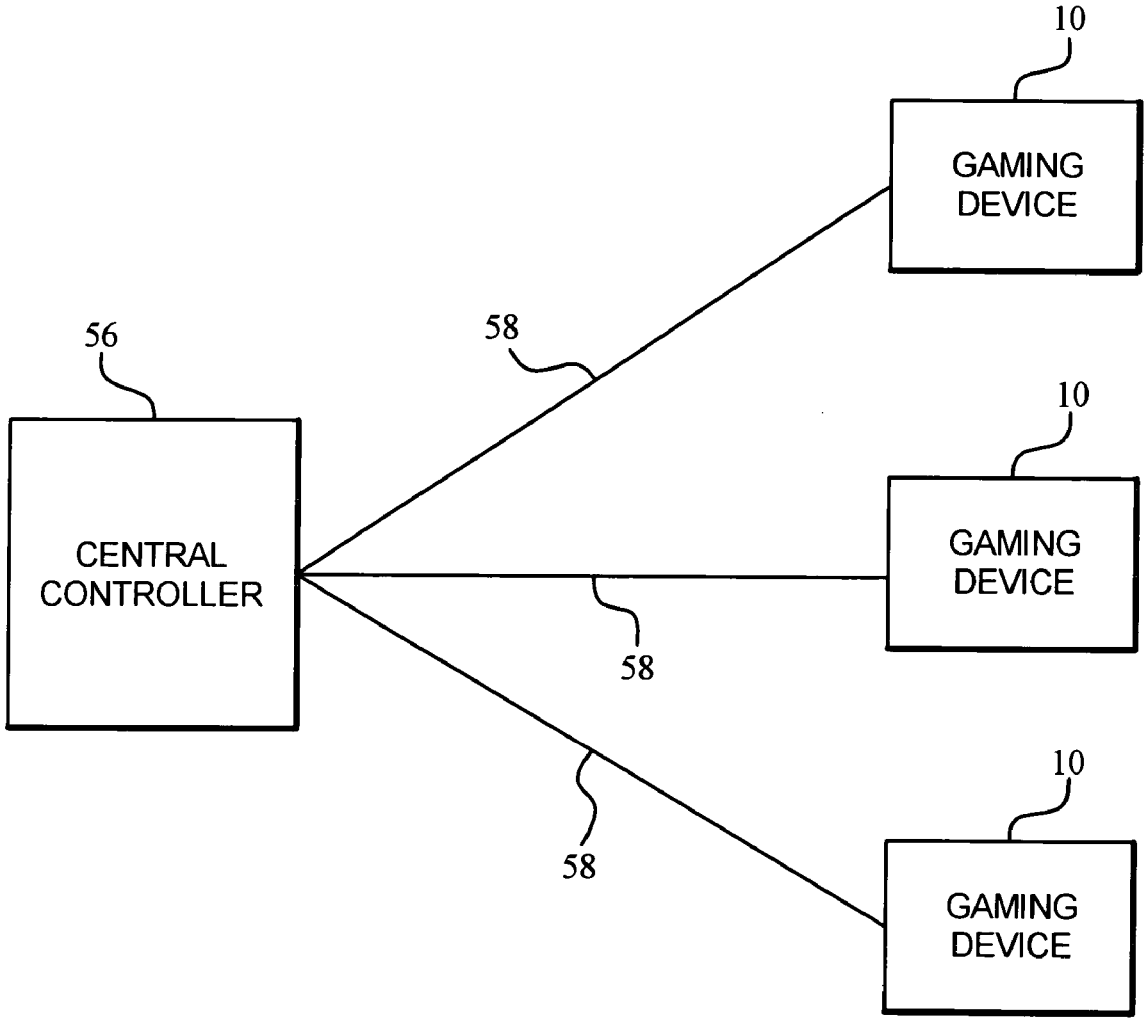
FIG. 2B is a schematic block diagram of one embodiment of a network configuration for a plurality of gaming devices disclosed herein.

In one embodiment, as illustrated in FIG. 2B, one or more of the gaming devices 10 may be connected to each other through a data network or a remote communication link 58 with some or all of the functions of each gaming device provided at a central location such as a central server or central controller 56. More specifically, the processor of each gaming device may be designed to facilitate transmission of signals between the individual gaming device and the central server or controller.

In one embodiment, the game outcome provided to the player is determined by a central server or controller and provided to the player at the gaming device. In this embodiment, each of a plurality of such gaming devices are in communication with the central server or controller. Upon a player initiating game play at one of the gaming devices, the initiated gaming device communicates a game outcome request to the central server or controller.

In one embodiment, the central server or controller receives the game outcome request and randomly generates a game outcome for the primary game based on probability data. In another embodiment, the central server or controller randomly generates a game outcome for the secondary game based on probability data. In another embodiment, the central server or controller randomly generates a game outcome for both the primary game and the secondary game based on probability data. In this embodiment, the central server or controller is capable of storing and utilizing program code or other data similar to the processor and memory device of the gaming device.

In an alternative embodiment, the central server or controller maintains one or more predetermined pools or sets of predetermined game outcomes. In this embodiment, the central server or controller receives the game outcome request and independently selects a predetermined game outcome from a set or pool of game outcomes. The central server or controller flags or marks the selected game outcome as used. Once a game outcome is flagged as used, it is prevented from further selection from the set or pool and cannot be selected by the central controller or server upon another wager. The provided game outcome can include a primary game outcome, a secondary game outcome, primary and secondary game outcomes, or a series of game outcomes such a free games.

The central server or controller communicates the generated or selected game outcome to the initiated gaming device. The gaming device receives the generated or selected game outcome and provides the game outcome to the player. In an alternative embodiment, how the generated or selected game outcome is to be presented or displayed to the player, such as a reel symbol combination of a slot machine or a hand of cards dealt in a card game, is also determined by the central server or controller and communicated to the initiated gaming device to be presented or displayed to the player. Central production or control can assist a gaming establishment or other entity in maintaining appropriate records, controlling gaming, reducing and preventing cheating or electronic or other errors, reducing or eliminating win-loss volatility and the like.

In another embodiment, a predetermined game outcome value is determined for each of a plurality of linked or networked gaming devices based on the results of a bingo or keno game. In this embodiment, each individual gaming device utilizes one or more bingo or keno games to determine the predetermined game outcome value provided to the player for the interactive game played at that gaming device. In one embodiment, the bingo or keno game is displayed to the player. In another embodiment, the bingo or keno game is not displayed to the player, but the results of the bingo or keno game determine the predetermined game outcome value for the interactive game.

In the various bingo embodiments, as each gaming device is enrolled in the bingo game, such as upon an appropriate wager or engaging an input device, the enrolled gaming device is provided or associated with a different bingo card. Each bingo card consists of a matrix or array of elements, wherein each element is designated with a separate indicia, such as a number. It should be appreciated that each different bingo card includes a different combination of elements. For example, if four bingo cards are provided to four enrolled gaming devices, the same element may be present on all four of the bingo cards while another element may solely be present on one of the bingo cards.

In operation of these embodiments, upon providing or associating a different bingo card to each of a plurality of enrolled gaming devices, the central controller randomly selects or draws, one at a time, a plurality of the elements. As each element is selected, a determination is made for each gaming device as to whether the selected element is present on the bingo card provided to that enrolled gaming device. This determination can be made by the central controller, the gaming device, a combination of the two, or in any other suitable manner. If the selected element is present on the bingo card provided to that enrolled gaming device, that selected element on the provided bingo card is marked or flagged. This process of selecting elements and marking any selected elements on the provided bingo cards continues until one or more predetermined patterns are marked on one or more of the provided bingo cards. It should be appreciated that in one embodiment, the gaming device requires the player to engage a "daub" button (not shown) to initiate the process of the gaming device marking or flagging any selected elements.

After one or more predetermined patterns are marked on one or more of the provided bingo cards, a game outcome is determined for each of the enrolled gaming devices based, at least in part, on the selected elements on the provided bingo cards. As described above, the game outcome determined for each gaming device enrolled in the bingo game is utilized by that gaming device to determine the predetermined game outcome provided to the player. For example, a first gaming device to have selected elements marked in a predetermined pattern is provided a first outcome of win $10 which will be provided to a first player regardless of how the first player plays in a first game and a second gaming device to have selected elements marked in a different predetermined pattern is provided a second outcome of win $2 which will be provided to a second player regardless of how the second player plays a second game. It should be appreciated that as the process of marking selected elements continues until one or more predetermined patterns are marked, this embodiment insures that at least one bingo card will win the bingo game and thus at least one enrolled gaming device will provide a predetermined winning game outcome to a player. It should be appreciated that other suitable methods for selecting or determining one or more predetermined game outcomes may be employed.

In one example of the above-described embodiment, the predetermined game outcome may be based on a supplemental award in addition to any award provided for winning the bingo game as described above. In this embodiment, if one or more elements are marked in supplemental patterns within a designated number of drawn elements, a supplemental or intermittent award or value associated with the marked supplemental pattern is provided to the player as part of the predetermined game outcome. For example, if the four corners of a bingo card are marked within the first twenty selected elements, a supplemental award of $10 is provided to the player as part of the predetermined game outcome. It should be appreciated that in this embodiment, the player of a gaming device may be provided a supplemental or intermittent award regardless of if the enrolled gaming device's provided bingo card wins or does not win the bingo game as described above.

In another embodiment, one or more of the gaming devices are in communication with a central server or controller for monitoring purposes only. That is, each individual gaming device randomly generates the game outcomes to be provided to the player and the central server or controller monitors the activities and events occurring on the plurality of gaming devices. In one embodiment, the gaming network includes a real-time or on-line accounting and gaming information system operably coupled to the central server or controller. The accounting and gaming information system of this embodiment includes a player database for storing player profiles, a player tracking module for tracking players and a credit system for providing automated casino transactions.

A plurality of the gaming devices are capable of being connected together through a data network. In one embodiment, the data network is a local area network (LAN), in which one or more of the gaming devices are substantially proximate to each other and an on-site central server or controller as in, for example, a gaming establishment or a portion of a gaming establishment. In another embodiment, the data network is a wide area network (WAN) in which one or more of the gaming devices are in communication with at least one off-site central server or controller. In this embodiment, the plurality of gaming devices may be located in a different part of the gaming establishment or within a different gaming establishment than the off-site central server or controller. Thus, the WAN may include an off-site central server or controller and an off-site gaming device located within gaming establishments in the same geographic area, such as a city or state. The WAN gaming system may be substantially identical to the LAN gaming system described above, although the number of gaming devices in each system may vary relative to each other.

In another embodiment, the data network is an internet or intranet. In this embodiment, the operation of the gaming device can be viewed at the gaming device with at least one internet browser. In this embodiment, operation of the gaming device and accumulation of credits may be accomplished with only a connection to the central server or controller (the internet/intranet server) through a conventional phone or other data transmission line, digital subscriber line (DSL), T-1 line, coaxial cable, fiber optic cable, or other suitable connection. In this embodiment, players may access an internet game page from any location where an internet connection and computer, or other internet facilitator are available. The expansion in the number of computers and number and speed of internet connections in recent years increases opportunities for players to play from an ever-increasing number of remote sites. It should be appreciated that enhanced bandwidth of digital wireless communications may render such technology suitable for some or all communications, particularly if such communications are encrypted. Higher data transmission speeds may be useful for enhancing the sophistication and response of the display and interaction with the player.

In another embodiment, as described above, one or more gaming devices are in communication with a central server or controller. The central server or controller may be any suitable server or computing device which includes at least one processor and a memory or storage device. In alternative embodiments, the central server is a progressive controller or another gaming machine in the gaming system. In one embodiment, the memory device stores different game programs and instructions, executable by a gaming device processor, to control the gaming device. Each executable game program represents a different game or type of game which may be played on one or more of the gaming devices in the gaming system. Such different games may include the same or substantially the same game play with different pay tables. In different embodiments, the executable game program is for a primary game, a secondary game or both. In another embodiment, the game program may be executable as a secondary game to be played simultaneous with the play of a primary game (which may be downloaded to or fixed on the gaming device) or vice versa.

In this embodiment, each gaming device at least includes one or more display devices and/or one or more input devices for interaction with a player. A local processor, such as the above-described gaming device processor or a processor of a local server, is operable with the display device(s) and/or the input device(s) of one or more of the gaming devices.

In operation, the central controller is operable to communicate one or more of the stored game programs to at least one local processor. In different embodiments, the stored game programs are communicated or delivered by embedding the communicated game program in a device or a component (e.g., a "chip" to be inserted in a gaming device), writing the game program on a disc or other media, downloading or streaming the game program over a dedicated data network, internet or a telephone line. After the stored game programs are communicated from the central server, the local processor executes the communicated program to facilitate play of the communicated program by a player through the display device(s) and/or input device(s) of the gaming device. That is, when a game program is communicated to a local processor, the local processor changes the game or type of game played at the gaming device.

In another embodiment, a plurality of gaming devices at one or more gaming sites may be networked to a central server in a progressive configuration, as known in the art, wherein a portion of each wager to initiate a base or primary game may be allocated to bonus or secondary event awards. In one embodiment, a host site computer is coupled to a plurality of the central servers at a variety of mutually remote gaming sites for providing a multi-site linked progressive automated gaming system. In one embodiment, a host site computer may serve gaming devices distributed throughout a number of properties at different geographical locations including, for example, different locations within a city or different cities within a state.

In one embodiment, the host site computer is maintained for the overall operation and control of the system. In this embodiment, a host site computer oversees the entire progressive gaming system and is the master for computing all progressive jackpots. All participating gaming sites report to, and receive information from, the host site computer. Each central server computer is responsible for all data communication between the gaming device hardware and software and the host site computer. In one embodiment, an individual gaming machine may trigger a progressive win, for example through a game play event such as a symbol-driven trigger. In one embodiment, the central server or other central controller determines when a progressive win is triggered. In one embodiment, a central controller and an individual gaming machine work in conjunction with each other to determine when a progressive win is triggered, for example through an individual gaming machine meeting a predetermined requirement established by the central controller.

Process Flow

Figure 3:
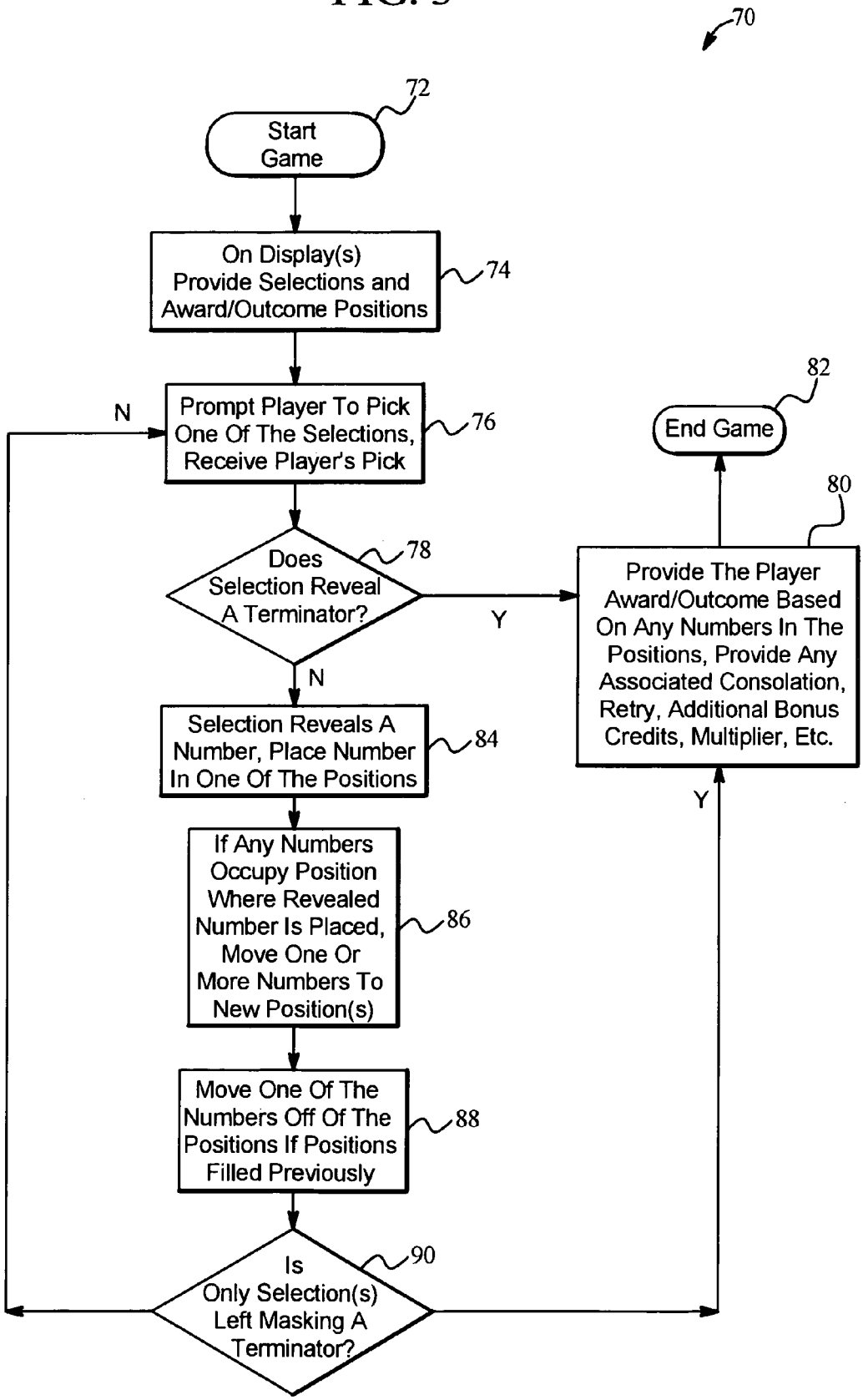
FIG. 3 is a process flow diagram showing one possible flow sequence of the present disclosure.

Referring now to FIG. 3, one sequence of operation of one embodiment of the present disclosure is illustrated by method or sequence 70. Method or sequence 70 is started as indicated by oval 72. In one embodiment, the game of the present disclosure is a base or primary wagering game. In such case, starting the game involves wager of a designated amount of money. After the player inputs enough money to play the game, the player press's the start or play button 24. In another embodiment, as discussed above, the game is a secondary or bonus game, which is played in combination with a base or primary game. In such case, a designated result or outcome in the base game triggers play of the sequence or method 70 in one embodiment.

Upon starting or triggering the game as indicated by oval 72, gaming device 10 displays or provides a plurality of masked selections to the player as indicated by block 74. The gaming device also displays a plurality of positions into which numbers (or other suitable symbols, such as playing cards) selected by the player are placed. The selections and positions or digit places may be displayed on the same display or on different displays. The selections are displayed in an embodiment with touch screen 42 and touch screen controller 44. Here, the player picks a masked selection by simply touching the selection. In an alternative embodiment, the gaming device employs electromechanical input devices 30. In that case, the player presses a button corresponding to a desired masked selection, and the display devices 16 or 18 reveals the selection. Examples of the selections and the positions or digits are shown and described in detail below.

Display devices 16 or 18 and/or speakers 50 provide an audio, visual or audiovisual prompt to the player to pick one of the selections as indicated by block 76. The processor 12 of gaming device 10 then receives a signal corresponding to the player's pick of one of the selections as also indicated by block 76.

After the player picks one of the selections, gaming device 10 determines if the picked selection reveals a terminator, as indicated by diamond 78. If the selection chosen reveals a terminator, gaming device 10 provides the player an award or outcome based on any numbers residing currently in the positions or digits as indicated by block 80. In different embodiments, the number of terminators associated with the selections is predetermined, randomly determined, determined based on the wager placed, determined based on the player's status (such as determined through a player tracking system), determined based on time, or determined based on any other suitable method.

In certain instances, gaming device 10 provides a consolation prize or award to the player as also seen in connection with block 80. For example, if three positions or digit places are provided, and the player fills only one or two of the positions, gaming device 10 may provide a consolation award or outcome to the player. Alternatively, if the player's ultimate award is below a threshold or designated value, gaming device 10 can provide a consolation award. In a further alternative embodiment, the consolation or additional bonus is provided based on which selection has yielded terminator as determined in connection with diamond 78. In another implementation, the player wins an additional outcome or award if the player picks each of the selections masking numbers, as determined in connection with diamond 90.

The consolation or additional bonus pay can have any suitable form, such as a multiplier, a number of credits, a retry, a non-monetary value or award, and any combination thereof. In one embodiment, if the player receives a terminator on the first pick of a selection, gaming device 10 provides the player a re-pick or retry to pick a different selection. Gaming device 10 may re-shuffle or re-randomize the marked selections in such case, so that the terminator picked initially is placed back into the pool of outcomes. In one alternative embodiment, one or more of the digit positions have starting values or numbers which are predetermined, randomly determined, determined based on the wager placed, determined based on the player's status (such as determined through a player tracking system), determined based on time, or determined based on any other suitable method. In one embodiment, the game is scripted such that one or more designated numbers will be revealed to the player in a specific order, regardless of which selections the player picks.

If the pick of a selection does not yield a terminator, as determined in connection with diamond 78, the picked selection reveals a number instead. Gaming device 10 places that number in one of the positions or digit places as indicated by block 84. As shown below, in one embodiment gaming device 10 places the newly revealed number in the one's digit place and shifts any existing numbers one digit to the left, or an one order of magnitude higher. In alternative embodiments, gaming device 10 places the newly revealed number in a left most or highest order position or digit place. Further alternatively, gaming device 10 places the newly revealed number in an intermediate or middle position or digit place. It should also be appreciated that the amount or number of shifts can vary in alternative embodiments.

In one embodiment, the newly placed number shifts or moves at least one existing number if it exists. That is, the newly revealed number is placed in a position that is currently occupied by a number if at least one other number has already been generated. As illustrated below, in one embodiment the position or digits are initially empty. In an alternative embodiment, at least one of the positions can be initially occupied by a desired number, for example, the number one or five. In another embodiment, each revealed number is associated with a designated digit place and the gaming device places the revealed number in the designated digit place associated with the revealed number. In this embodiment, if another number previously occupies the designated digit place, the other number is shifted or moved as described above. In another embodiment, one or more picked selections are each associated with a designated digit place. In this embodiment, each revealed number is positioned or placed in the digit place associated with the picked selection. In different embodiments, the designated digit place for each selection is predetermined, randomly determined, determined based on the wager placed, determined based on the player's status (such as determined through a player tracking system), determined based on the number of digits in the award, determined based on time, or determined based on any other suitable method.

As indicated by block 86, the placement of the newly revealed number moves each of one or more already existing numbers to a new position. If each of the positions or digits is occupied with a number prior to the generation of a new number, one of the numbers is removed from or shifted off of the positions. For example, if each of three positions or digits is filled and the player generates a new number, gaming device in one embodiment places that new number in the one's position and each of the existing numbers shifts to the left one order or magnitude higher, so that the number previously occupying the one hundred's digit is removed or moved off of the positions, as indicated by block 88.

The gaming device may determine whether the selections remaining for the player to pick conceal only terminators, as determined in connection with diamond 90. If at least one selection masking or concealing a number remains, sequence 70 enables the player to pick another selection, as indicated by block 76. The sequence between block 76 and diamond 90 is repeated until the player picks a selection that reveals a terminator, as determined in connection with diamond 78, or until the player picks each of the selections that reveal a number, as determined in connection with diamond 90. When either of those conditions occurs, the gaming device provides an outcome or award to the player and potentially an associated bonus or retry, as indicated by block 80.

After the gaming device provides an outcome or award due the player, the game ends as indicated in connection with oval 82. If the game of the present disclosure is a base game, the player has the opportunity to wager another wagerable amount and to play the game again or cash out any credits and discontinue gaming. If the game of the present disclosure is a bonus game, game play returns to that of the associated base game, and gaming device 10 enables the player to wager any credits from sequence 70.

In one embodiment, the gaming device enables the player to pick selections until a terminator is revealed. In another embodiment, the gaming device enables the player to pick selections until a plurality of terminators are revealed. In different embodiments, the number of terminators which must be revealed before causing a terminating event are predetermined, randomly determined, determined based on the wager placed, determined based on the player's status (such as determined through a player tracking system), determined based on time, or determined based on any other suitable method. In another embodiment, the gaming device enables the player to pick selections until a designated number of selections are picked or until a terminator is revealed. In different embodiments, the designated number of selections are predetermined, randomly determined, determined based on the wager placed, determined based on the player's status (such as determined through a player tracking system), determined based on time, or determined based on any other suitable method. In another embodiment, the player must place a wager for one, more or each selection picked by the player.

Figure 4:
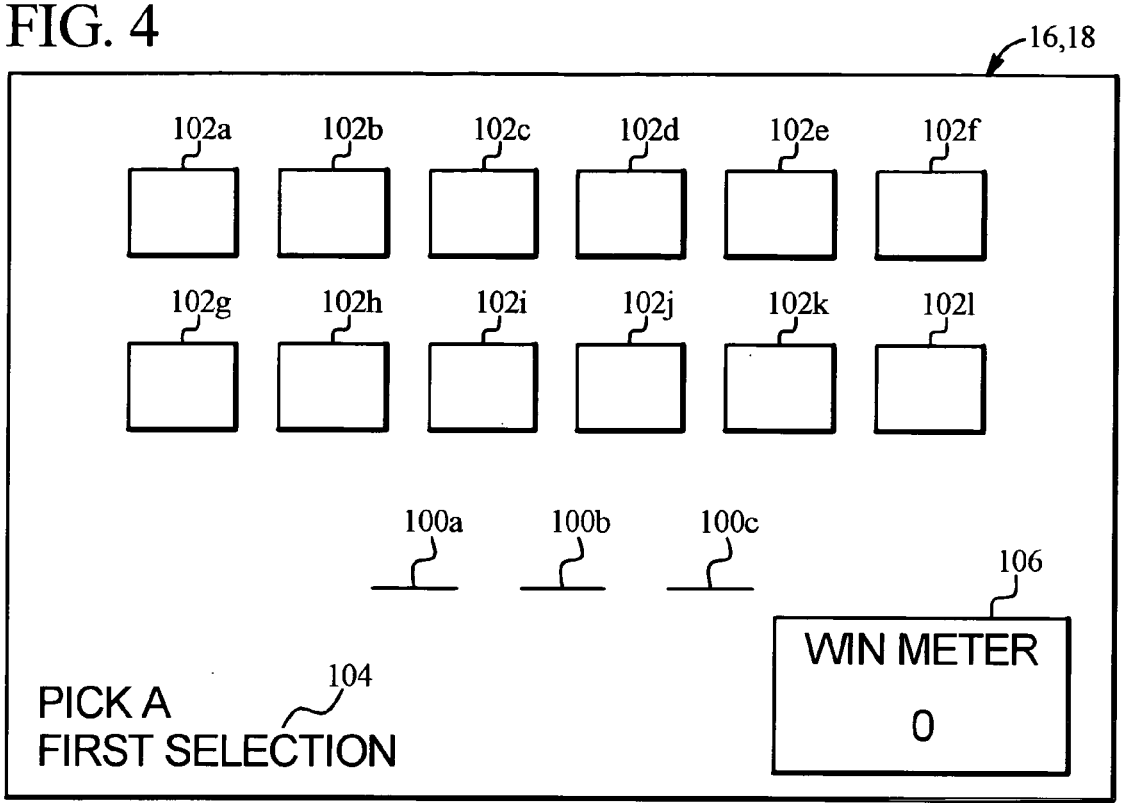
FIG. 4 is an elevation view of one of the display devices of the gaming machine showing one possible initial screen or display of the present disclosure.

Referring now to FIG. 4, a display device 16 or 18 illustrates one embodiment of a game play screen of the present disclosure. The screen of FIG. 4 is provided in connection with block 74 of sequence 70, for example. For ease of illustration, each of the relevant apparatus is shown on the same display device 16 or 18. In alternative embodiments, the relevant apparatuses are split up at different areas of gaming device 10. For example, selections 102 (referring collectively to selections 102*a* to 102*l* or referred to generally as selection 102) can be electromechanical and provided on the console of gaming device 10.

Display device 16 or 18 in FIG. 4 displays a plurality of positions 100*a* to 100*c* (referred to herein collectively as positions 100 or generally as position 100). In the illustrated embodiment, three positions are provided. In alternative embodiments, two or more positions may be provided. Three positions provides a dynamic and interesting game and also produces a result that is manageable and feasible. In different embodiments, the number of positions or digits in the player's award or outcome is predetermined, randomly determined, determined based on the wager placed, determined based on the player's status (such as determined through a player tracking system), determined based on time, or determined based on any other suitable method.

Gaming device 10 also displays a plurality of selections 102*a* to 102*l*. Selections 102 mask or conceal outcomes. In the embodiments illustrated herein, the outcomes include numbers or terminators. In an alternative embodiment, the terminator can also be associated with an additional award or consolation.

The display device 16 or 18 in FIG. 4 displays an audio, visual, or audiovisual message 104 prompting the player to pick one of the selections. The prompt corresponds to the prompting step 76 described in sequence 70. Display device 16 or 18 also provides a win meter 106. Win meter 106 eventually shows the player how many credits or other type(s) of award are provided to the player for playing the game of the present disclosure. Because the player has yet to win any award in FIG. 4, win meter 106 shows the number zero.

In the example illustrated below, the twelve selections 102*a* to 102*l* conceal the numbers zero through nine and two terminators. It should be appreciated that one or more of the numbers zero to nine may not be provided. Further, any one or more of the numbers zero to nine may be repeated or used more than once. Further, it is possible to provide multiple digit numbers, in which case the multiple digit number consumes or occupies a plurality of the positions 100 or digits 100. Also, the multiple digit numbers have the ability to move a plurality of the numbers simultaneously or shift a plurality of the numbers off of positions 100. In one embodiment, multiple digit numbers occupy a single position or digit. For example, in this embodiment, a previous three-digit award is converted or changed to a four-digit award if a multi-digit number is associated with a picked selection. It should be appreciated that other suitable outcomes could be associated with the selections.

Game with Player Selections and Changing Outcomes—Newly Picked Numbers Placed in One's Digit FIGS. 5 to 10 illustrate an example of one embodiment of the present disclosure. Here, three positions or digits 100 are used. Also, newly revealed numbers are placed in the one's digit 100*c* in this embodiment of the present disclosure. Any number residing currently in the one's digit place 100*c* is moved to the ten's digit place or position 100*b*. Likewise, any number residing currently in the ten's position or digit place 100*b* is moved or shifted to the one hundred's position or digit place 100*a*. Furthermore, any number currently residing in the one hundred's position or digit place 100*a* is moved off of or eliminated from the positions or digit places.

Figure 5:
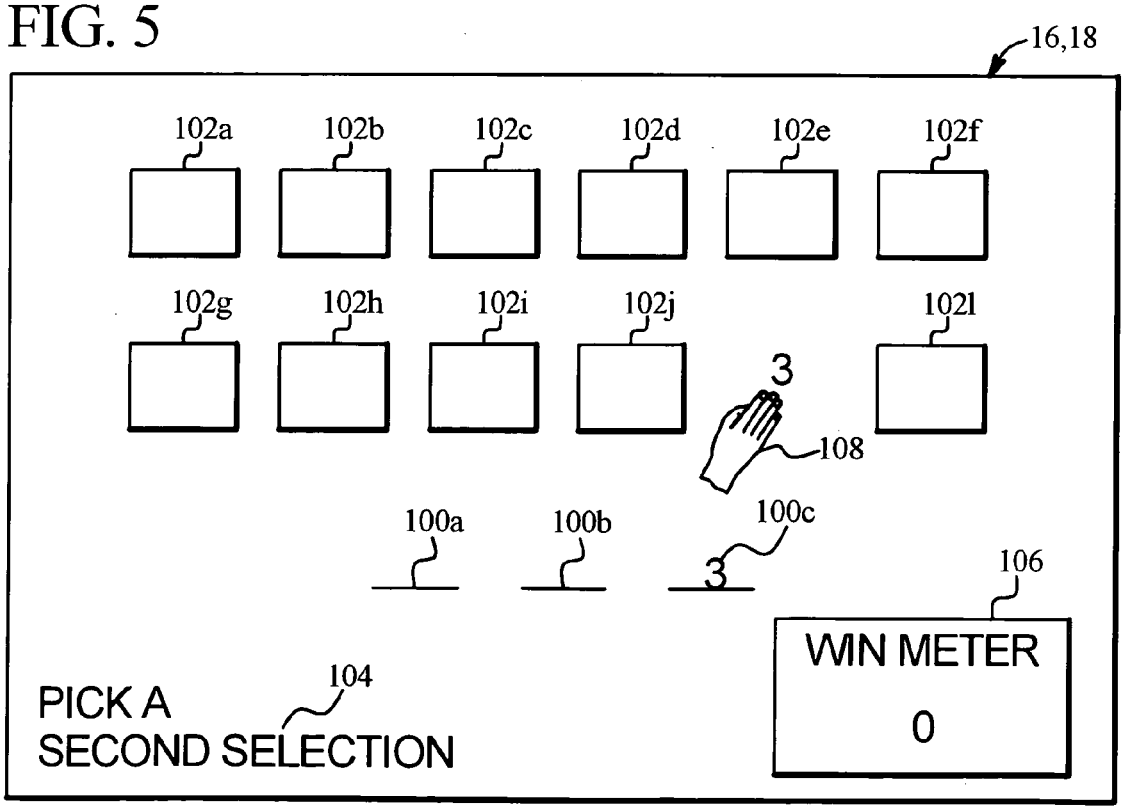
FIGS. 5, 6, 7, 8, 9 and 10 are elevation views of one of the display devices of the gaming machine showing one example of the base or bonus game of the present disclosure.

Based on the prompt 104 in FIG. 4, a player 108 in FIG. 5 picks selection 102*k*. Selection 102*k* reveals the number three. Gaming device 10 therefore places the number three in the one's position or digit 100*c*. As discussed above, if the player 108 at the point of the game in FIG. 5 picks a selection that reveals a terminator, gaming device 10 in an embodiment enables a player to retry or redo the pick. In such case, gaming device 10 can reshuffle or reorganize the numbers and terminators concealed by or associated with the individual selections 102*a* to 102*l*. In an alternative embodiment, gaming device 10 provides a consolation prize or award to the player, such as a consolation amount of credits, non-monetary award, a free spin or play in the base game, etc. In another alternative embodiment, one or more or all of the positions 100*a* to 100*c* are filled initially. For example, each of the positions may be filled with the number one, so that the player wins at least 111 credits. Alternatively, if the game is a base or primary game, the player may simply lose or obtain no credits if the player picks a selection revealing a terminator initially. In one embodiment the amount of the wager, a portion thereof, or a multiple thereof may be employed in the digits. In one such embodiment, where the game is a primary game, multiple zeros or terminators may be associated with the selections based on the overall paytable.

In FIG. 5, gaming device 10 provides a suitable prompt 104 prompting the player to pick a second selection. Accordingly, in FIG. 6 player 108 picks selection 102*a*. Selection 102*a* reveals the number four. The number four is placed in the one's position or digit place 100*c* in one embodiment. The number three residing currently in the one's digit place 100*c* is moved, shifted or slid to the ten's position or digit place 100*b*.

Figure 6:
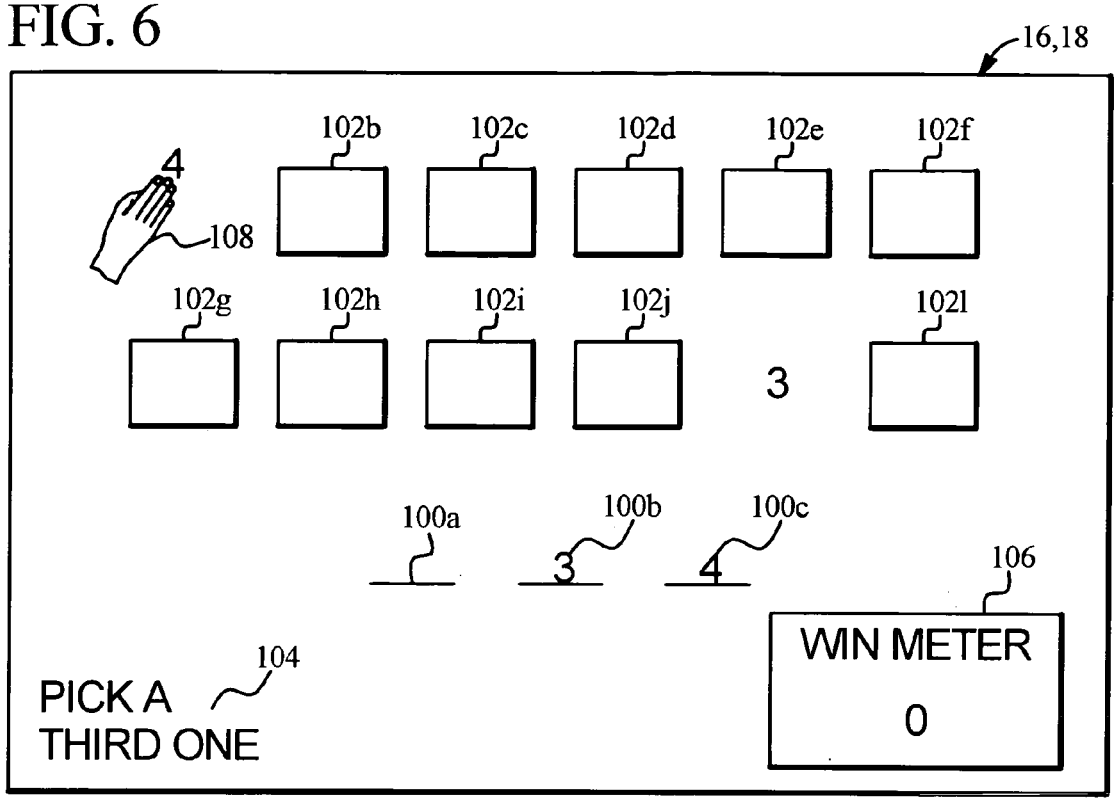

As illustrated in FIGS. 5 and 6, win meter 106 shows that the player currently has obtained no credits or award from play of the game. It should be appreciated however that the player is guaranteed a win or outcome of three if the player in the screen of FIG. 6 picks a terminator. Further, if the player 108 in FIG. 7 picks a terminator, the player is guaranteed an award or outcome of thirty-four. That is, in one embodiment the outcome or award is the overall number formed by the individual numbers in the digits or positions 100*a* to 100*c*. As discussed herein, in alternative embodiments that number is modified, such as multiplied. It is also possible to shift or rearrange the numbers in the position 100 upon a certain event or as a consolation to the player.

Figure 7:
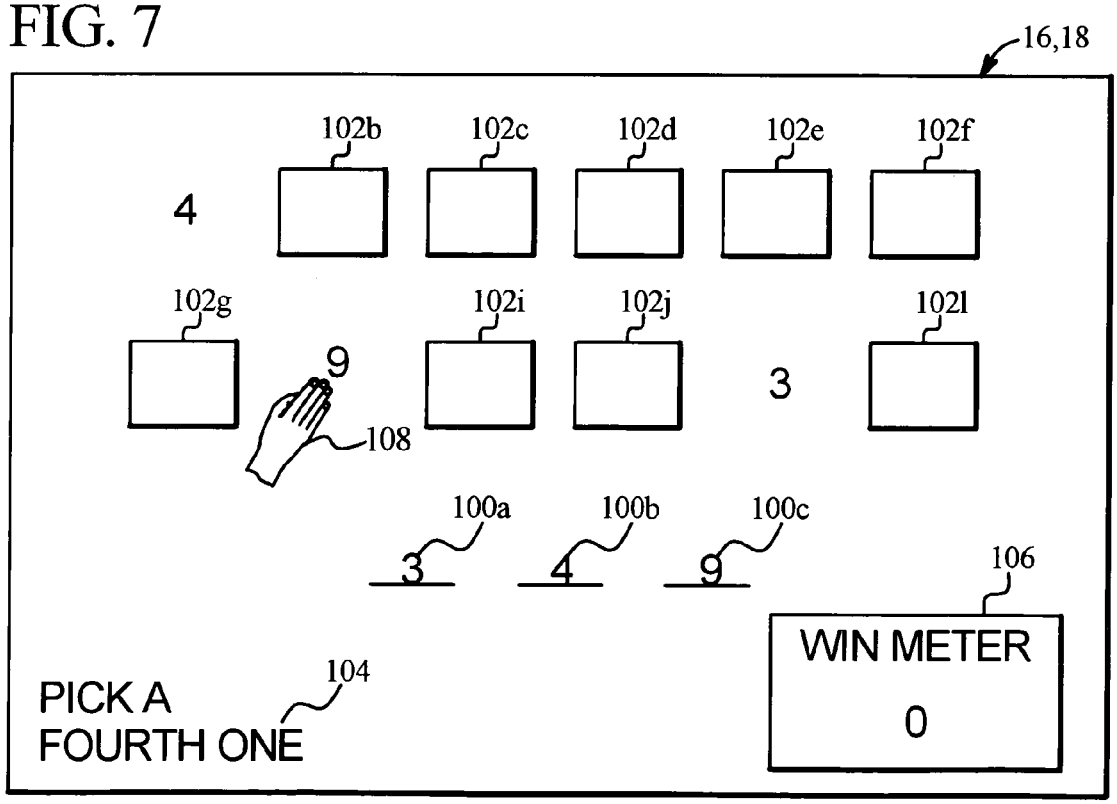

Prompt 104 in FIG. 6 prompts player 108 to pick a third one of the selections. Accordingly, player 108 in FIG. 7 picks selection 102*h*. Selection 102*h* is revealed to show that the player has generated the number nine. The number nine is placed in the one's position or digit place 100*c*. The number four is moved from the one's digit place 100*c* to the ten's digit place. The number three is moved from the ten's digit place 106*b* to the one hundred's digit place 100*a*. In the illustrated embodiment, display device 16 or 18 continues to display the revealed numbers in place of the associated selection 102. Such display provides the player with a sense of whether a currently revealed number is a relatively high or low number. It also provides the player with an opportunity to guess the numbers that may be remaining behind or concealed by any unselected selections and/or the location(s) of a terminator. As seen in FIG. 7, if the player next picks a terminator, the player in one embodiment is provided an award or outcome of three hundred forty-nine.

Figure 8:
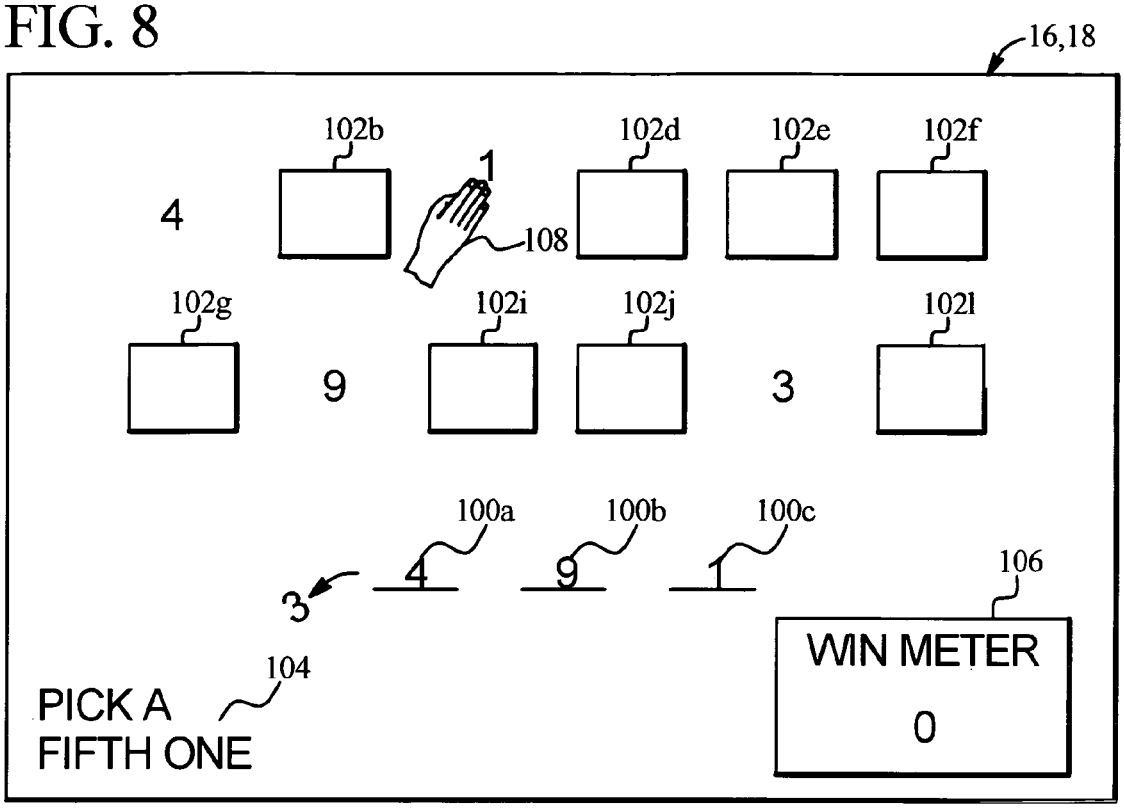

Prompt 104 in FIG. 7 prompts the player to pick a fourth one of the selections 102. As seen in FIG. 8, player 108 picks selection 102*c*, which reveals the number one. The number one is placed in the one's digit place or position 100*c*. The number nine is moved, shifted or slid from the one's position or digit place 100*c* to the ten's position or digit place 100*b*. The number four is moved, shifted or slid from the ten's position or digit place 100*b* to the one hundred's position or digit place 100*a*. Further, the number three is moved off of or eliminated from the positions 100 from the one hundred's position or digit place 100*a*. The number three is no longer part of the player's award or outcome. In one embodiment, the number three is gone for the remainder of the game. Alternatively, the number three may be revealed upon the pick of another selection or alternatively stored next to the number four in case it needs to be recalled in a later segment of the game.

The player's selection in FIG. 8 created an interesting dynamic with number nine (i.e., the relatively highest number) placed next to the number one (i.e., the relatively lowest number). The player's award can therefore change rather drastically upon just one pick of a selection.

Figure 9:
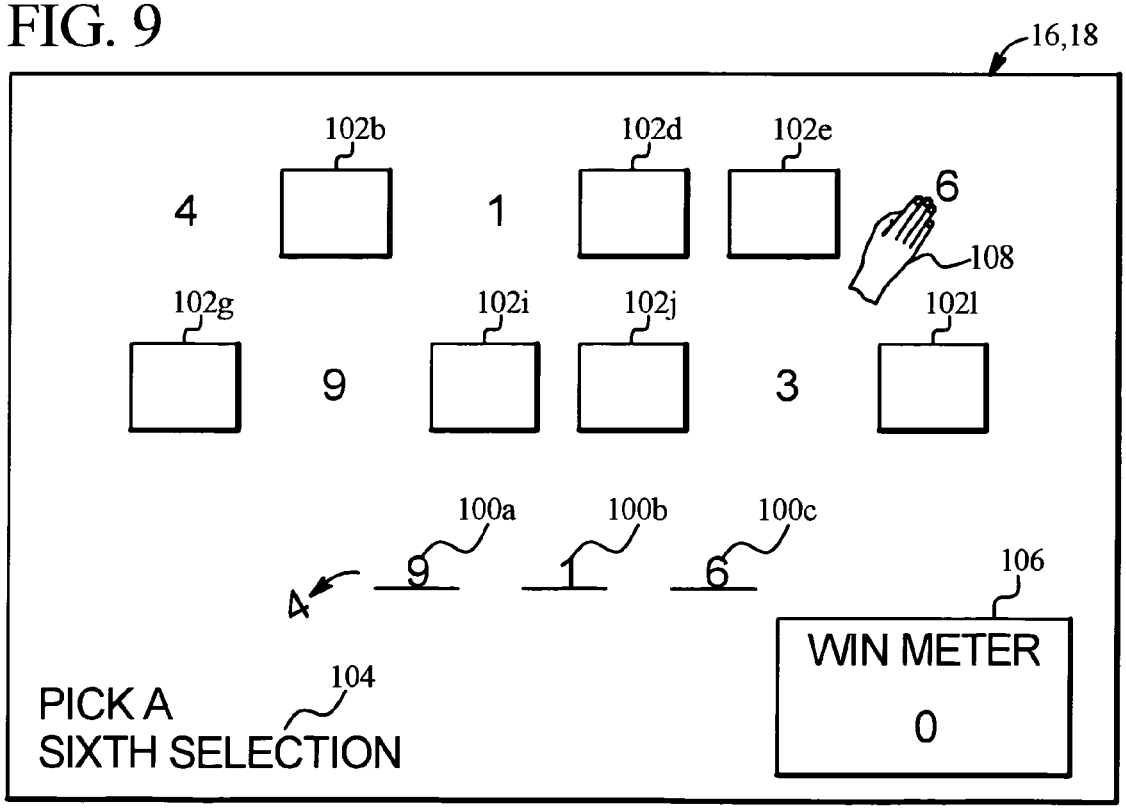

Prompt 104 in FIG. 8 prompts the player to pick a fifth one of the selections. As seen in FIG. 9, player 108 picks selection 102*f*. Selection 102*f* is revealed to show the number six. The number six is placed in position or digit place 100*c*. The number one is moved from the one's position 100*c* to the ten's position or digit place 100*b*. The number nine is moved from the ten's digit or position place 100*b* to the one hundred's position or digit place 100*a*. The number four residing currently in the one hundred's position 100*a* is moved off of or eliminated from the positions or digit places 100.

The outcome shown in FIG. 9 furthers the dynamic in which the player desires the next pick to be a terminator, so that the player can accumulate a relatively high value or outcome of over nine hundred. Further, if the player picks another number shifting the number one to the one hundred's digit place 100*c*, the player will most certainly want the following pick to also yield a number, to prevent an award or outcome between one hundred and two hundred.

Figure 10:
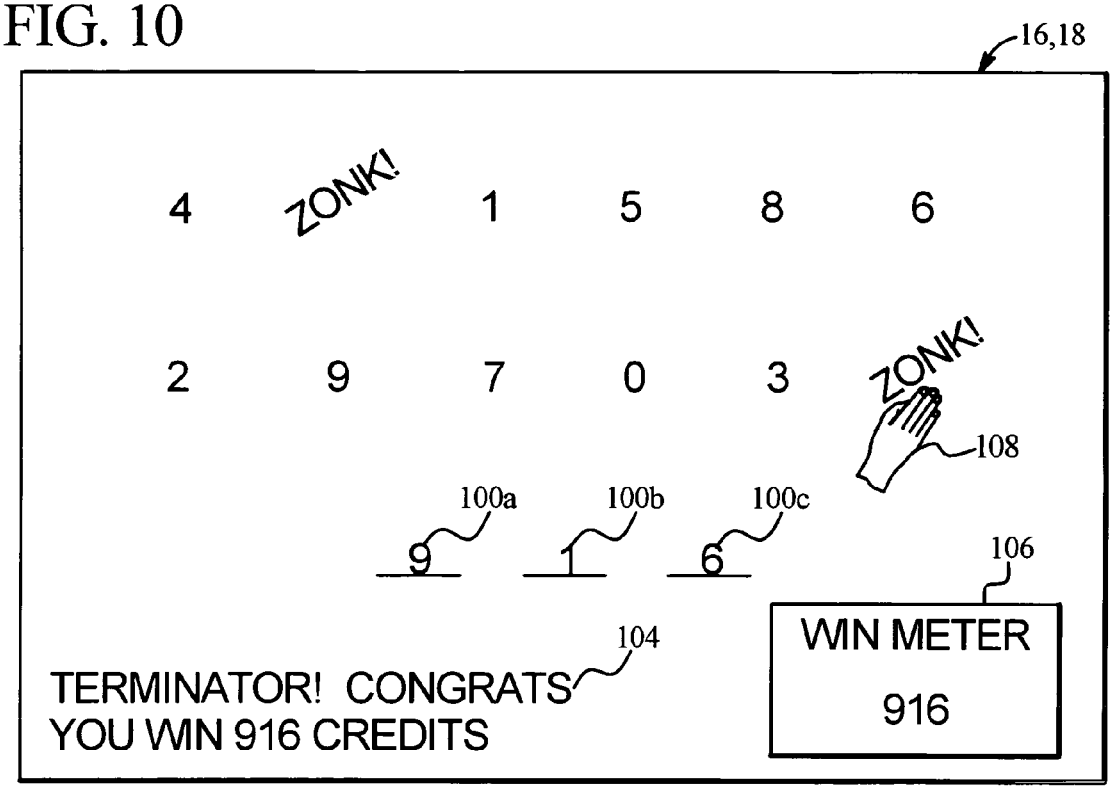

Prompt 104 in FIG. 9 prompts the player to pick a sixth one of the selections. As seen in FIG. 10, player 108 next picks selection 102*l*. Selection 102*l* is revealed to show a terminator or termination outcome. The terminator ends the selection sequence. The player's award shown in win meter 106 is in one embodiment the overall number defined by the numbers in digit places or positions 100*a* to 100*c*. Here, message 104 and win meter 106 indicate that the player wins nine hundred-sixteen credits. In an alternative embodiment, the player's award shown in win meter 106 is a modification of the overall number defined by the numbers in digit places or positions 100*a* to 100*c*. Alternatively, the player's award shown in win meter 106 is a modification numbers in digit places or positions 100*a* to 100*c*. For example, the digits could be rearranged, added to or subtracted from. As stated above, any suitable award modification or consolation may be provided in association with the terminator outcome. Such modification can be in the form of a consolation if for example the overall number defined by the numbers in digits or positions 100*a* to 100*c* is below a preset threshold, or if the player picks a terminator too early on in the selection sequence.

FIG. 10 also illustrates that in one embodiment the remaining unpicked selections 102 are each revealed upon termination of the sequence. Fun and excitement can be increased by showing the player what the player missed or avoided. As seen in FIG. 10, the game uses two terminators and ten numbers. The numbers zero through nine are each used once and not repeated. In an alternative embodiment, one, some or all of the numbers zero through nine are not used. In another alternative embodiment, one, some or all of the numbers zero through nine are repeated one or more times. In a further alternative embodiment, selections 102 reveal one or more numbers having more than one digit. Here, multi-digit numbers can move multiple existing numbers or another multi-digit number to different positions 100 or off of the positions 100 in the latter case (if the positions are full or if there is not enough positions to move or shift a multi-digit number). Alternately, multi-digit numbers may be placed into a single digit place. In this embodiment, the number of digits in the award may be increased by one or more digit places. For example, if a two-digit number is placed in a single digit place of four digit award, the four digit award is modified to a five digit award. Also, selections 102 may conceal any desired percentage loading of terminators.

In an alternative embodiment the present disclosure provides an automatic or processor initiated generation of one or more or all of the selections or one or more or all of the digits. That is, the player does not have to pick the selections, although player interaction is desirable. Instead, gaming device 10 or a processor operable with the gaming device generates the selections or the numbers without associating the numbers with the selections randomly. In such case, one or more numbers or selections may be weighted to be generated more or less often than at least one other selection or number. It should also be appreciated that the selections may be weighted by providing more of one number associated with a plurality of selections than another number. In another embodiment, the gaming device enables the player to pick digit places or positions and the gaming device generates one or more numbers to place in the player picked digit place.

In FIG. 10, the player is lucky to receive an award over nine hundred. Had the player picked an additional number, the number one would have been moved to the one hundred's digit 100*a*. At that point, the player would have had only five remaining selections to choose from, two of which would yield terminators. It should be appreciated from the foregoing example that the myriad of combinations of sequences that may play out upon the player's picks yields a game that will seldom be repeated and is constantly changing.

Figure 11:
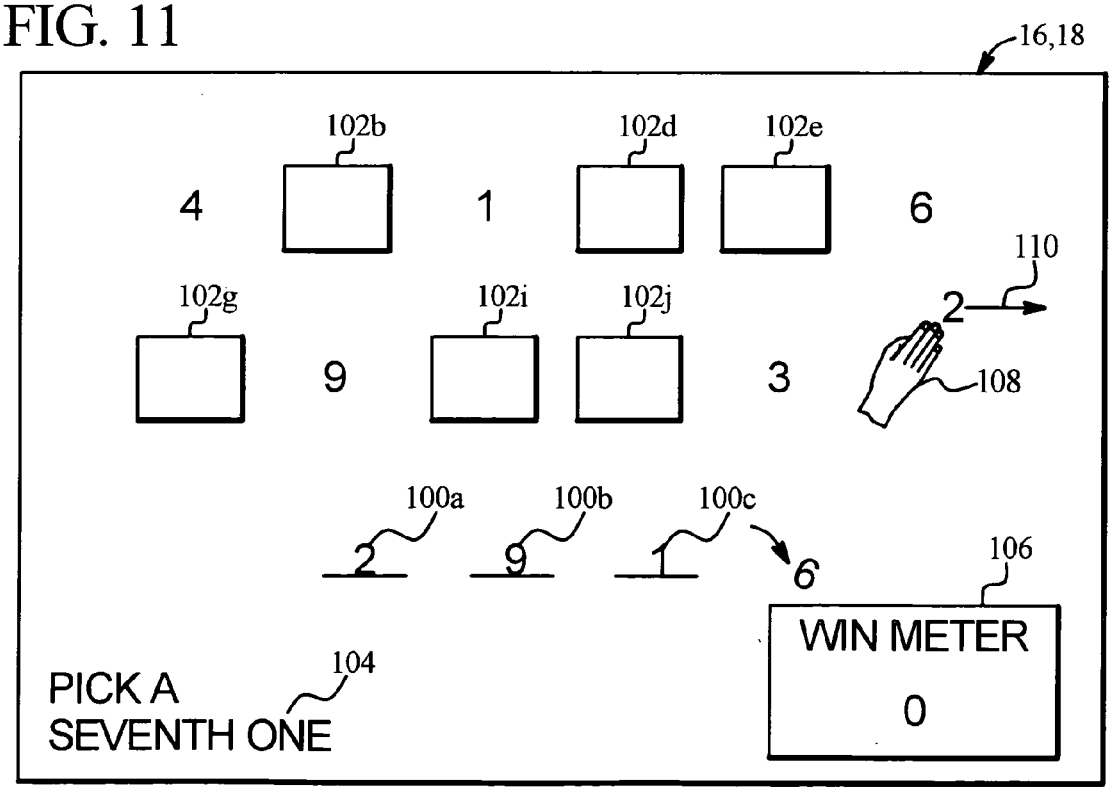
FIGS. 11, 12, 13, 14 and 15 are elevation views of one of the display devices of the gaming machine showing various alternative embodiments that use directional indicators in combination with the numbers forming the outcomes of the present disclosure.

Game with Player Selections and Changing Outcomes—Newly Picked Numbers Associated with Directional Indicator Referring now to FIG. 11, an alternative result from the sixth pick of the selections (FIG. 10) shows one alternative embodiment of the present disclosure. As seen in FIG. 11, player 108 picks selection 102*l* as is done in FIG. 10. Selection 102*l* here however is revealed to show a number two in association with a right facing indicator 110. Right facing indicator 110 signals or indicates that the newly generated number two will enter or approach the existing numbers in positions or digit places 100*a* to 100*c* from the left. Right facing indicator 110 also signals or indicates that the newly generated number two will push the number in the one's digit place off of the positions or digit places 100 if each of such positions or digit places are each occupied with a number.

As illustrated in FIG. 11, the generated number two according to right facing indicator 110 is placed in one hundred's position or digit place 100*a*. The number nine is moved or shifted to the right or down a decade from the one hundred's position 100*a* to the ten's position or digit place 100*b*. The number one in turn is moved from the ten's digit place or position 100*b* to the right or down one decade to the one's position or digit place 100*c*. The number six in the one's digit place 100*c* is moved to the right off of the positions 100.

Indicator 110 may be directly associated with the generated number as illustrated or be generated elsewhere on display device 16 or 18 or elsewhere or gaming device 10 but at generally the same time as the number, so that the player knows that the indicator is associated with the number. For example, a separate box or meter may be provided, similar to a possession arrow in a basketball game, which indicates whether the next or currently generated number is to be placed in the highest order or lowest order digit place. The player may or may not know the direction prior to picking the next selection 102. In either case, an interesting dynamic is presented to the player who may wish for one or another type of indicator gaming device 10 may associate an indicator (e.g., indicator 110) with each of the numbers, with only certain numbers or only at certain times. Because the player in FIG. 11 has yet to pick a terminator, prompt 104 prompts the player to pick a seventh one of the selections. No award is shown yet in win meter 106.

Figure 12:
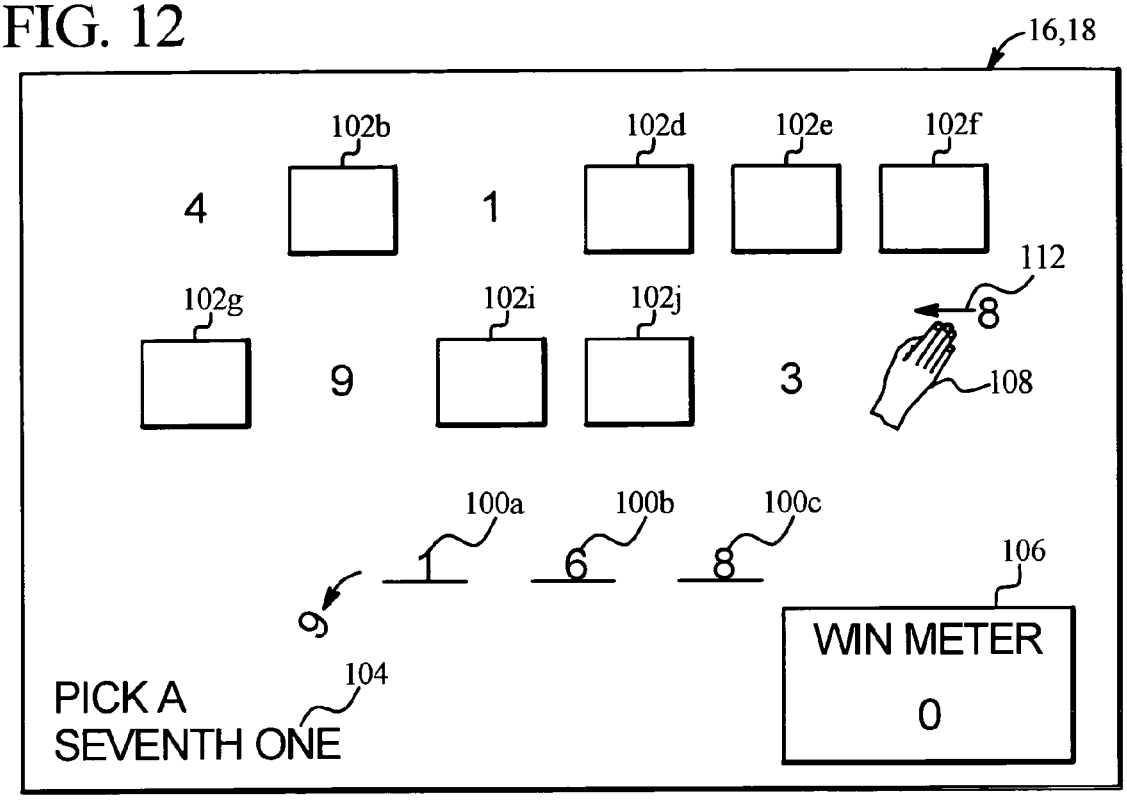

Referring now to FIG. 12, an alternative result from the sixth pick of the selections (FIG. 10) shows that a complimentary left facing indicator 112 may also be provided and generated. As seen in FIG. 12, player 108 picks selection 102*l* as is done in FIGS. 10 and 11. Selection 102*l* here is revealed to show a number eight in association with a left facing indicator 112. Left facing indicator 112 signals or indicates that the newly generated number eight will enter or approach the existing numbers in positions or digits 100*a* to 100*c* from the right. Left facing indicator 110 also signals or indicates that the newly generated number eight will push the highest digit off of the positions or digit places 100 if each of such positions or digit places are each occupied with a number.

As seen in FIG. 12, the number eight is accordingly placed in one's position or digit place 100*c*. The number six is moved from the one's position 100*c* left or up a decade to the ten's position or digit place 100*b*. The number one is moved from the ten's digit place or position 100*b* left or up a decade to the one hundred's position or digit place 100*a*. The number nine residing currently in the one hundred's position 100*a* is moved left or off of the positions or digit places 100. In short, left facing indicator 112 causes the newly picked number to behave as described above in connection with FIGS. 5 to 10. Because the player in FIG. 12 has yet to pick a terminator, prompt 104 prompts the player to pick a seventh one of the selections. No award is shown yet in win meter 106.

Figure 13:
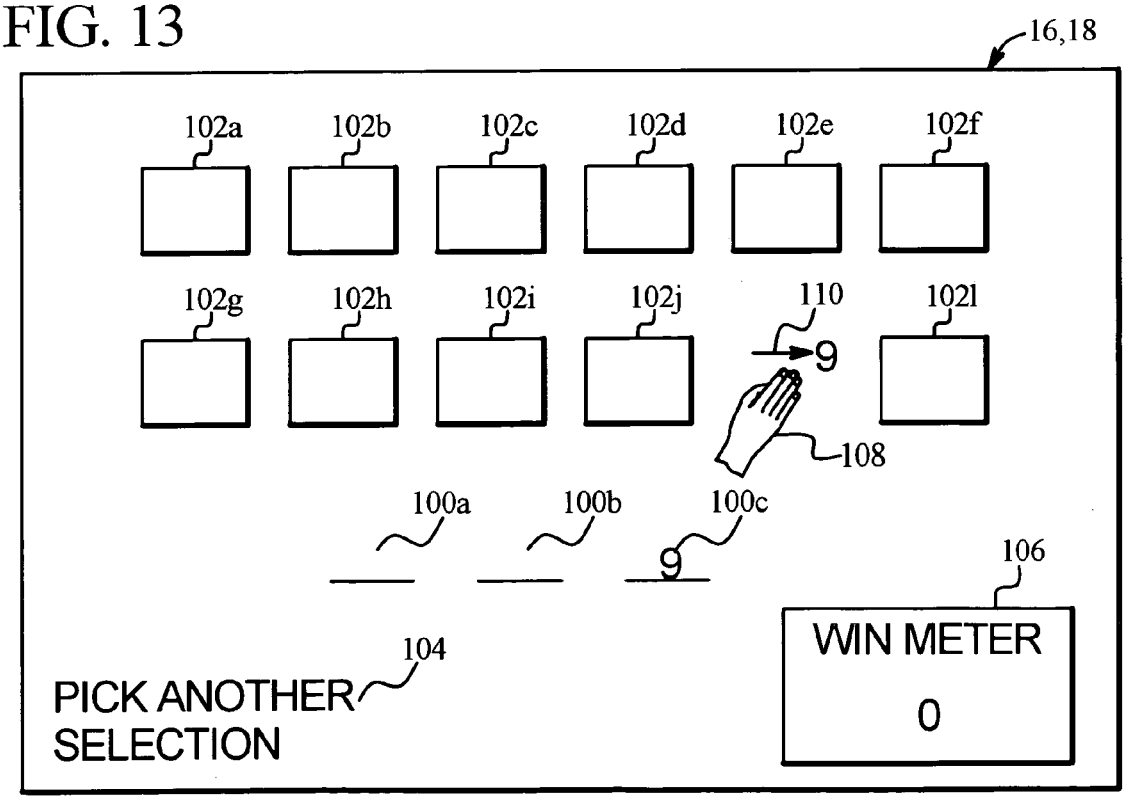

Right facing indicator 110 presents a number of alternative ways to present the game of the present disclosure. FIG. 13 illustrates one situation in which the number nine is associated with right facing indicator 110 on the player's first pick or at any time when no positions or digit places 100 are currently filled. In one embodiment, the number nine is placed in the one hundred's digit 100*a*. In another embodiment, the number nine is placed in an intermediate position or digit place, such as position or digit place 100*b*. In the illustrated embodiment, the number nine is moved or slid as far right as possible and placed in the one's position or digit place 100*c*. In the illustrated embodiment, the overall number is filled right to left or lowest digit place to highest digit place regardless of whether the indicators 110 and 112 are used.

If the one hundred's or ten's digit place is alternatively filled first before the other digit places, a situation can arise in which a terminator is generated and either or both the one's or ten's digit places 100*b* and 100*c* are not occupied. Gaming device 10 can either avoid this situation by filling right to left as discussed above or by automatically filling the empty one's and ten's digits, e.g., with a zero or a five.

Figure 14:
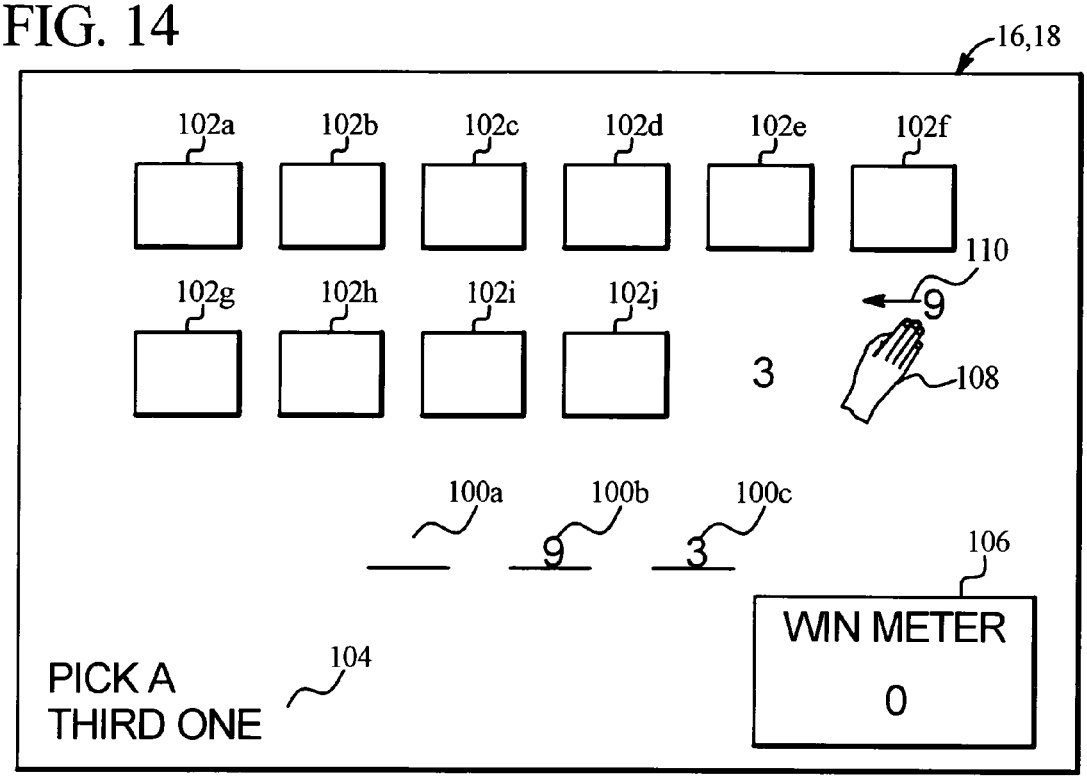

FIG. 14 illustrates another situation in which the number nine is associated with right facing indicator 110 on the player's second pick or at any time when only position 100*c* is currently filled. FIG. 14 starts from the point in the game after FIG. 5, namely, upon the second pick of the selections 102 and with the number three in the one's position 100*c*. Because the player in FIG. 14 has yet to pick a terminator, prompt 104 prompts the player to pick a third one of the selections. No award is shown yet in win meter 106.

In the embodiment illustrated in FIG. 14, the number nine is placed in the ten's digit place 100*b*, next to the existing number three, which is located in the one's digit place 100*c*. Here, unlike above, an existing number is not moved. The same result would occur if only the one's and ten's positions are filled, that is, the newly picked number is placed next to the existing numbers in the one hundred's digit place 100*a*. This embodiment tends to promote a quicker filling of each of the positions or digit places 100. When each of the digit places 100 is filled, the next number from the selections 102 moves one of the end numbers off of the highest or lowest positions or digit places depending which indicator 110 or 112 is associated with that number.

Figure 15:
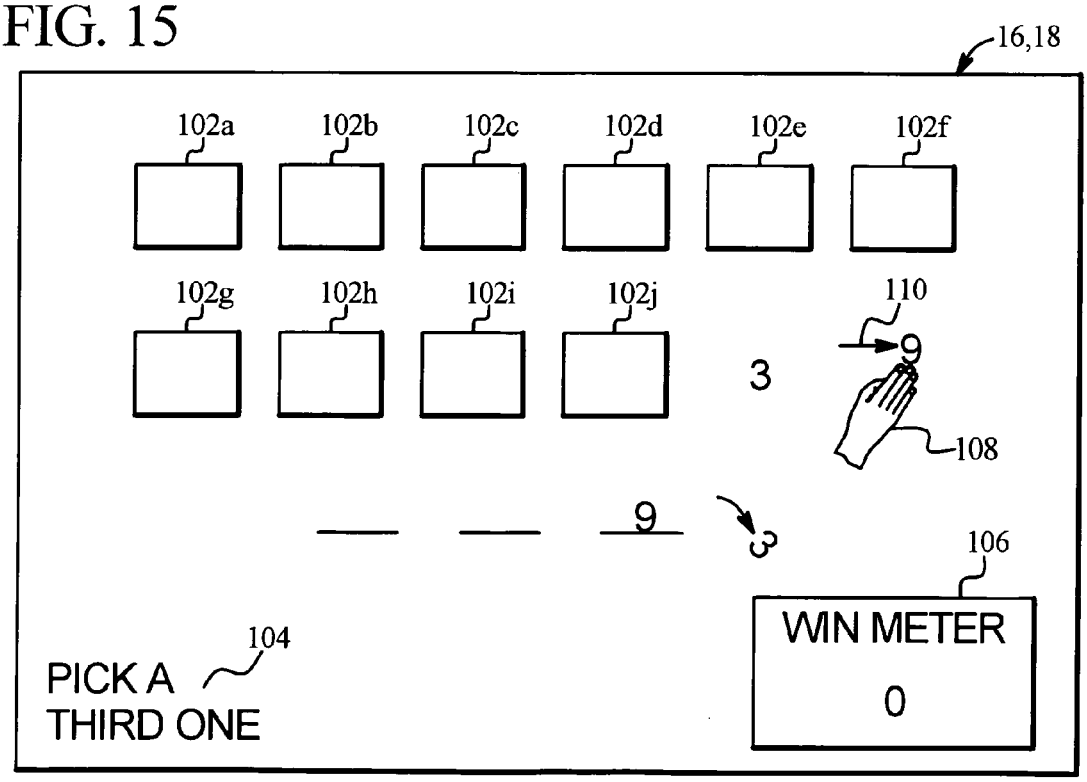

FIG. 15 illustrates the same situation as in FIG. 14, in which the number nine is associated with right facing indicator 110 on the player's second pick or at any time when only position 100*c* is currently filled. FIG. 15 also starts from the point in the game after FIG. 5, namely, upon the second pick of the selections 102 and with the number three in the one's position 100*c*. Because the player in FIG. 15 has yet to pick a terminator, prompt 104 prompts the player to pick a second one of the selections. No award is shown yet in win meter 106.

In this alterative embodiment illustrated in FIG. 15, however, the number nine is placed in the one's digit place 100*c* and moves or shifts the existing number three in the one's digit place 100*c* off of the positions or digit places 100. Here, an existing number is moved even though the positions are not filled and the net effect of the player's pick will not result in a new overall number that has increased by an order of magnitude over the previous number. That is, the player after the pick of selection 102*l* still only has a single digit award. This embodiment tends to promote more movement of numbers off of the positions, which may be visually entertaining. In this embodiment, the same result would occur if only the one's and ten's positions are filled, that is, the newly picked number is placed in the ten's digit place or position 100*b*, the number currently in the ten's digit place 100*b* is moved to the one's digit place 100*c*, and the number currently in the one's digit place 100*c* is moved to the right off of the positions or digit places 100. In an alternative embodiment, the numbers are placed into digit places in a designated order and one or more selections are associated with a "switch direction" symbol which modifies or changes the order which the revealed numbers are placed into digit places of the player's award or outcome.

In another embodiment, if each digit place of the player's award or outcome is currently occupied by a number, upon the revealing of another number, the gaming device replaces one or more occupied digits and does not shift any existing numbers from any existing digit places. That is, in this embodiment, rather than a revealed number shifting one or more previously revealed numbers one or more digit places, once each digit place of the player's award or outcome is currently occupied by a number, each subsequently revealed number replaces at least one existing number without otherwise affecting the remaining existing numbers. For example, if the player's three-digit award or outcome is currently two-hundred-thirty-one (i.e., the number two in the hundred's position or digit place, the number three in the ten's position or digit place and the number one in the one's position or digit place) and a subsequently picked selection reveals the number seven, the revealed number seven can replace the number in the hundred's position, the number in the ten's position or the number in the one's position. In this example, if the number seven replaces the number three in the ten's position (without causing any shifting of the numbers in the hundred's digit place or the one's digit place), the player's new award or outcome is two-hundred-seventy-one (i.e., the number two in the hundred's position or digit place, the number seven in the ten's position or digit place and the number one in the one's position or digit place).

In another embodiment, one or more of the selections are associated with anti-terminators. In this embodiment, when an anti-terminator is revealed to be associated with a selection, the revealed anti-terminator nullifies the terminating effect of one or more subsequently revealed terminators. That is, if an anti-terminator is associated with a picked selection, the anti-terminator is retained or accumulated for subsequent use. If a terminator is associated with a subsequently picked selection and at least one anti-terminator is retained, the previously retained anti-terminator nullifies the effect of the terminator and allows the game to continue. If a terminator is associated with a subsequently picked selection and no anti-terminators are retained, as described above, the revealed terminator ends the play of the game.

In another embodiment, the present disclosure includes an accept or reject feature. This embodiment enables the player, at any time, to either accept the player's current award or reject the player's current award to try for a higher award. If the player accepts the player's current award (or the player's current award is the last award offered to the player), the player's current award is provided to the player and the game ends. If the player rejects the player's current award (and the player's current award is not the last award offered to the player), the gaming device enables the player to pick another selection to reveal another number. As described above, this revealed number modifiers the player's offered award (i.e., causes one or more previously revealed numbers to shift digit places or positions) and forms part of the player's subsequent offered award. In one embodiment, the gaming device provides the player a number of award offers which the player may accept or reject. In this embodiment, the number of award offers is predetermined, randomly determined, determined based on the wager placed, determined based on the player's status (such as determined through a player tracking system), determined based on time, or determined based on any other suitable method. In an alternative embodiment, rather than accepting or rejecting the player's current award as described above, the gaming device enables the player to accept or reject each individual revealed number. In this embodiment, if the player accepts an individual revealed number, that number is placed in one of the digit places of the player's award or outcome. If the player rejects an individual revealed number, such number is discarded and not placed in one of the digit places of the player's award or outcome.

In another embodiment, one or more of the selections are associated with award digit modifiers. In one embodiment, such award digit modifier may be in addition to or instead of a number or terminator associated with the selection as described above. In one embodiment, one or more award digit modifiers each add one or more digit places to the player's outcome or award. For example, if a picked selection is associated with an award digit modifier of "plus two digit places", a player's previous three-digit outcome or award is modified to a five-digit outcome or award. In another embodiment, one or more award digit modifiers each reduce or subtract one or more digit places from the player's outcome or award. For example, if a picked selection is associated with an award digit modifier of "minus one digit place", a player previous three-digit outcome or award is modified to a two-digit outcome or award. In another embodiment, at least one award digit modifier adds one or more digit places to the player's outcome or award and at least one award digit modifier reduces or subtracts one or more digit places from the player's outcome or award.

In another embodiment, one or more of the selections are associated with shuffle modifiers. In this embodiment, if a shuffle modifier is revealed as associated with a picked selection, the numbers which currently occupy the digit places of the player's award or outcome are shuffled to different digit places or positions. In one such embodiment, the numbers of the player's award are randomly shuffled to different digit places or positions. For example, if the player's award is three-thousand-four-hundred-twenty-nine (i.e., the number three in the thousand's position or digit place, the number four in the hundred's position or digit place, the number two in the ten's position or digit place and the number nine in the one's position or digit place) and the player's picked selection reveals a shuffle modifier, the player's award is shuffled to four-thousand-three-hundred-ninety-two (i.e., the number four in the thousand's position or digit place, the number three in the hundred's position or digit place, the number nine in the ten's position or digit place and the number two in the one's position or digit place). In another embodiment, the numbers of the player's award are shuffled in a predetermined manner, such as circling from left to right or right to left. For example, if the player's award is three-thousand-four-hundred-twenty-nine (i.e., the number three in the thousand's position or digit place, the number four in the hundred's position or digit place, the number two in the ten's position or digit place and the number nine in the one's position or digit place) and the player's picked selection reveals a shuffle modifier, the player's award is shuffled from left-to-right to result in an award of four-thousand-two-hundred-ninety-three (i.e., the number four in the thousand's position or digit place, the number two in the hundred's position or digit place, the number nine in the ten's position or digit place and the number three in the one's position or digit place).

In another embodiment, one or more of the selections are associated with switch modifiers. In this embodiment, if a switch modifier is revealed as associated with a picked selection, the numbers of two or more currently occupied digit places of the player's award or outcome are switched or swapped. For example, if the player's award is six-thousand-seven-hundred-twenty-three (i.e., the number six in the thousand's position or digit place, the number seven in the hundred's position or digit place, the number two in the ten's position or digit place and the number three in the one's position or digit place) and the player's picked selection reveals a switch modifier, the player's award is shuffled to six-thousand-seven-hundred-thirty-two (i.e., the number six in the thousand's position or digit place, the number seven in the hundred's position or digit place, the number three in the ten's position or digit place and the number two in the one's position or digit place). In different embodiments, the digit places or positions which are switched are predetermined, randomly determined, determined based on the wager placed, determined based on the player's status (such as determined through a player tracking system), determined based on time, or determined based on any other suitable method.

In another embodiment, one or more of the selections are associated with "delete low value" modifiers. In this embodiment, if a picked selection reveals a "delete low value" modifier, the lowest valued number in the player's award is replaced or otherwise modified to a higher valued number. In another embodiment, one or more of the selections are associated with "swap high/low value" modifiers. In this embodiment, if a picked selection reveals a "swap high/low value" modifier, the lowest valued number in the player's award changes digit places or positions with the highest valued number in the player's award.

In another embodiment, one or more functional symbols, such as a multiplier symbol or an addition symbol, are associated with the plurality of selections. In this embodiment, if a functional symbol is revealed, that functional symbol is placed or positioned in one of the digit places or positions of the player's award or outcome. The positioned functional symbol modifies the other numbers placed or positioned at digit places of the player's award or outcome. In one embodiment, the functional symbol is treated the same as the revealed numbers described above (i.e., such functional symbol may be shifted or eliminated from the player's award). In another embodiment, if a functional symbol is revealed, the player's award or outcome is increased by one or more digit places to accommodate for the revealed functional symbols. For example, if the player's award or outcome is seven-hundred-twelve (i.e., the number seven in the thousand's position or digit place, the number one in the hundred's position or digit place and the number two in the one's position or digit place) and a functional multiplier symbol is revealed, the functional multiplier is placed between the ten's digit place and the one's digit place such that the player's award or outcome is one-hundred-forty-two (or 71×2). In different embodiments, the placement of each functional symbol may be predetermined, randomly determined, determined based on the wager placed, determined based on the player's status (such as determined through a player tracking system), determined based on time, or determined based on any other suitable method. In one embodiment, one or more functional symbols are each also associated with a number (such as a functional symbol of "4×").

Figure 16:
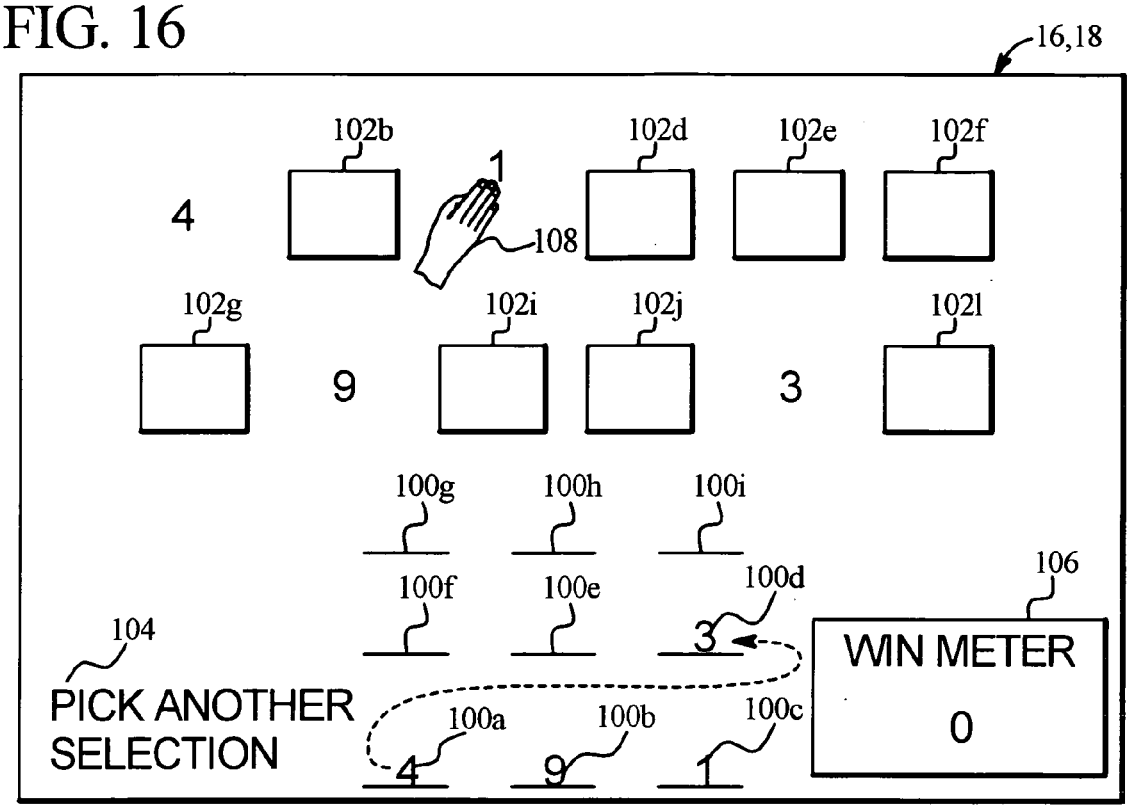
FIG. 16 is an elevation view of one of the display devices of the gaming machine showing an alternative embodiment of the game of the present disclosure.

In another embodiment, as illustrated in FIG. 16, the gaming device includes a plurality of levels wherein each level includes a multi-digit number. In this embodiment, a number that is eliminated from a multi-digit number of one level may be added to another multi-digit number of another level. For example, as illustrated in FIG. 16, the gaming device may include three levels that each include a three-digit number, wherein the first three revealed numbers are positioned or placed in the hundred's, ten's and one's digits of the first three-digit number of the first level as described above. In this example, if a multi-digit number of three-hundred-forty-nine has been previously formed (i.e., the number three in the hundred's position or digit place, the number four in the ten's position or digit place and the number nine in the one's position or digit place) and the player 108 picks selection 102*c*, which reveals the number one. The number one is placed in the one's digit place or position 100*c*. The number nine is moved, shifted or slid from the one's position or digit place 100*c* to the ten's position or digit place 100*b*. The number four is moved, shifted or slid from the ten's position or digit place 100*b* to the one hundred's position or digit place 100*a*. Further, the number three is moved from the hundreds digit place 100*a* of the first multi-digit number to the one's digit place 100*d* of the second multi-digit number. Accordingly, the number three is no longer part of the player's award or outcome for the first level and is now part of the player's award or outcome for the second level. In this example, until a terminating event occurs, the revealed numbers are continually shifted to unoccupied digit places until all digit places are occupied (i.e., each of the three digit places of each of the three multi-digit numbers include revealed numbers) and revealed numbers are eliminated from the multi-digit numbers. It should be appreciated that the example illustrated in FIG. 16, not until the tenth number is revealed will the first revealed number be eliminated from the hundred's digit of the third multi-digit number of the third level. In different embodiments, the revealed numbers may shift or move up to down, down to up, left to right, right to left or in any suitable manner. In these embodiments, the direction(s) the revealed numbers shift are based on one or more player picked selections (as described above), predetermined, randomly determined, determined based on the wager placed, determined based on the player's status (such as determined through a player tracking system), determined based on time, or determined based on any other suitable method.

Figure 17:
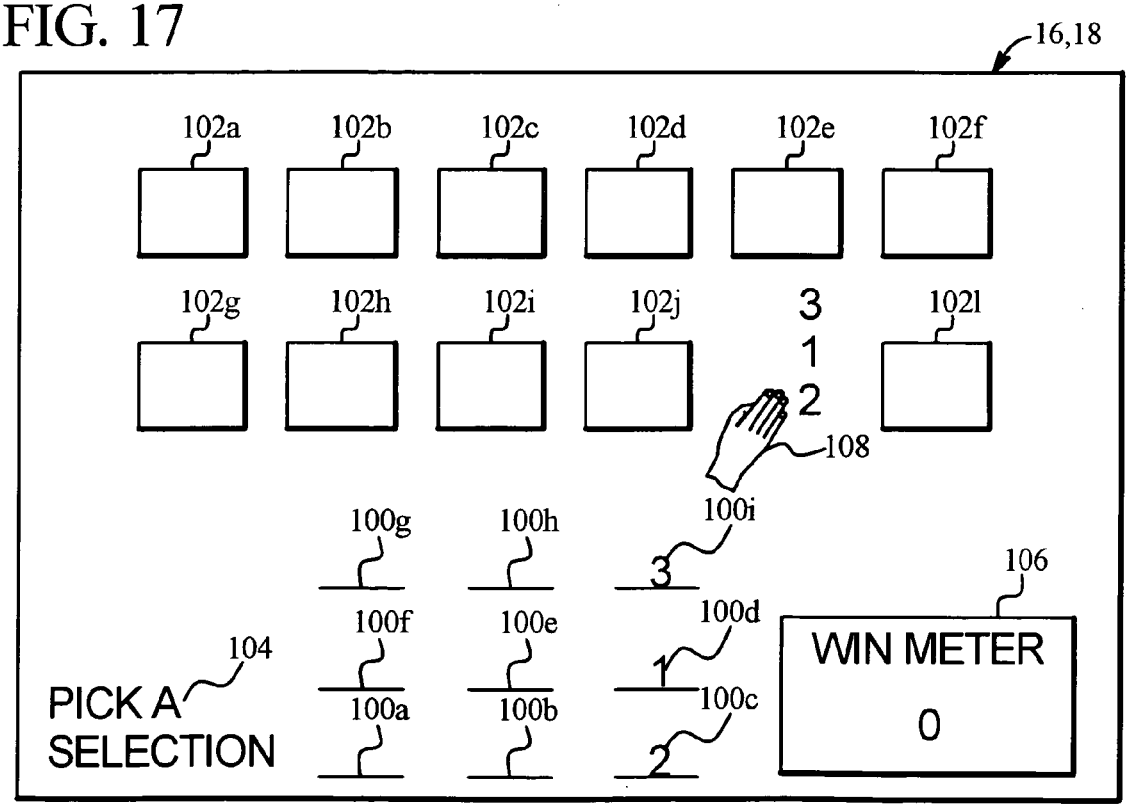
FIG. 17 is an elevation view of one of the display devices of the gaming machine showing an alternative embodiment of the game of the present disclosure.

In another embodiment including a plurality of levels of multi-digit numbers, a plurality of selections are each associated with one or more numbers to be placed in the appropriate digit place for one or more levels of multi-digit numbers. In one embodiment, at least one selection is associated with a plurality of numbers vertically arranged (i.e., at least two numbers to fill at least one digit place for each of at least two multi-digit numbers). In this embodiment, each vertically arranged number is associated with a designated level, wherein if the player's picked selection is associated with one or more vertically arranged numbers, each vertically arranged number is positioned or placed in a digit place or position of the multi-digit number associated with the level of the revealed number. For example, as illustrated in FIG. 17, if the player's picked selections is associated with the vertically arranged numbers three, one and two, then the number three will be placed in the one's digit of the multi-digit number for one level, the number one will be placed in the one's digit of the multi-digit number for another level and the number two will be placed in the one's digit of the multi-digit number for another level. As described above, the player picks selections, one at a time, and based on the number(s) associated with the player picked selection, one or more numbers are placed in the appropriate digit places or positions of the multi-digit numbers for one or more levels and zero, one or more numbers previously placed at digit places or positions are shifted or moved accordingly. This process continues until a terminator is selected, wherein when a terminator is revealed, the game ends and the multi-digit numbers of one or more levels are provided to the player as the player's award or outcome.

In another embodiment, at least one selection is associated with a plurality of numbers horizontally arranged (i.e., at least two numbers to fill at least two digit places for one multi-digit number). In another embodiment, at least one selection is associated with a plurality of numbers vertically arranged and at least one selection is associated with a plurality of numbers horizontally arranged. It should be appreciated that in this embodiment, one or more of the previously placed numbers may be shifted horizontally or vertically depending on the arrangement of the revealed numbers associated with the player's picked selection. Continuing with the example illustrated in FIG. 17, if a horizontally arranged two digit number were subsequently revealed to be associated with the player's picked selection, the ten's digit place of the revealed two-digit number would be placed in the ten's digit place 100*b* of the first level and the one's digit place of the revealed two-digit number would be placed in the one's digit place 100*c* of the first level. Such placement of the one's digit place causes the one's digit place of the second level to shift to the one's digit place of the third level and the one's digit place of the third level to be eliminated.

In different embodiments, the number of levels of multi-digit numbers is predetermined, randomly determined, determined based on the wager placed, determined based on the player's status (such as determined through a player tracking system), determined based on time, or determined based on any other suitable method. In different embodiments, the number of digit places for each of the multi-digit numbers is predetermined, randomly determined, determined based on the wager placed, determined based on the player's status (such as determined through a player tracking system), determined based on time, or determined based on any other suitable method.

In one embodiment, the gaming device disclosed herein includes a plurality of different types of terminators. In one embodiment, different terminators are associated with different levels. In this embodiment, if a terminator associated with a designated level is revealed, the multi-digit number for that designated level is set or fixed. A set or fixed multi-digit number is not modified when other non-set multi-digit numbers are modified. For example, if a multi-digit number is set or fixed with a number in the ten's digit place and a number in the one's digit place, then any additionally revealed numbers will not be placed at any of the digit places of the set or fixed number (and thus the numbers in the ten's and one's digit places will not be shifted or moved).

In another embodiment, a player is enabled to lock or hold one or more digit places or positions of a multi-digit number. In this embodiment, if a player locks or holds a digit place, then the number which currently occupies that digit place will remain in that digit place even if the numbers of the other digit places are moved or shifted. In another embodiment, the gaming device includes this locking feature with a plurality of levels of multi-digit numbers. In this embodiment, a first multi-digit number which includes a plurality of numbers is formed. In different embodiments, the numbers which form this first multi-digit number are based on one or more player picked selections (as described above), predetermined, randomly determined, determined based on the wager placed, determined based on the player's status (such as determined through a player tracking system), determined based on time, or determined based on any other suitable method. In this embodiment, the gaming device enables the player to pick one or more digit places of this first multi-digit number wherein each picked digit place is locked for each of the multi-digit numbers in the plurality of levels. In other words, this embodiment includes a plurality of multi-digit numbers which are simultaneously formed based on one or more of the player's picked selections as described above.

For example, if the first multi-digit number for a first level includes the number three in the hundred's digit place, the number six in the ten's digit place and the number two in the one's digit place and the player picks to lock the number six in the ten's digit place, each of the other multi-digit numbers for each of the other levels will include the number six in the ten's digit place. In one embodiment, the gaming device enables the player to unlock one or more previously locked digit places.

In another embodiment, an award or outcome includes a plurality of numbers in a plurality of digit places or positions wherein less than all of the numbers in the digit places form the player's award or outcome. In this embodiment, as described above, the player picks a plurality of selections which reveal a plurality of numbers which in turn are placed in digit places or positions of the player's multi-digit award or outcome. However, in this embodiment, upon a terminating event (such as the player picking a selection associated with a terminator or the player picking a designated number of selections), only part of the multi-digit number is provided to the player. For example, if the picked selections reveal a multi-digit number of sixty-seven thousand-eight-hundred-twelve (i.e., the number six in the ten thousand's position or digit place, the number seven in the thousand's position or digit place, the number eight in the hundred's position or digit place, the number one in the ten's position or digit place and the number two in the one's position or digit place), upon a terminating event, the gaming device determines that of this number, only the numbers seven, eight and one will form the player's award or outcome. Thus in this example, the player's formed outcome or award of seven-hundred-eighty-one (i.e., the number seven in the hundred's position or digit place, the number eight in the ten's position or digit place, the number one in the one's position) is provided to the player. That is, in this embodiment, only three of the five numbers revealed form the player's award or outcome which is actually provided to the player.

In another embodiment, the gaming device disclosed herein utilizes a moving indicator to determine the player's award or outcome. In this embodiment, a plurality of numbers are arranged adjacent to each other to form a string of numbers. In different embodiments, the numbers in the string of numbers are based on one or more player picked selections (as described above), predetermined, randomly determined, determined based on the wager placed, determined based on the player's status (such as determined through a player tracking system), determined based on time, or determined based on any other suitable method. In this embodiment, the player's award or outcome is dependent on the position of the moving indicator relative to the string of numbers. For example, if a string of numbers including the numbers three, zero, eight, nine, seven and six are adjacently arranged and the moving indicator indicates the first three numbers (i.e., the numbers three, zero and eight), then the player's award or outcome is three-hundred-eight. In this example (not shown), if the moving indicator is shifted or moved three spots or positions to the right (i.e., down the string of numbers to indicator the numbers nine, seven and six in the string of numbers), then the player's award or outcome is modified to nine-hundred-seventy-six.

In different embodiment, the number of digit positions the moving indicator may indicate at a time is predetermined, randomly determined, determined based on the wager placed, determined based on the player's status (such as determined through a player tracking system), determined based on time, or determined based on any other suitable method. It should be appreciated that the number of digit positions the moving indicator may indicate at a time may be set for each game play or may vary during game play. It should be further appreciated that the moving indicator may be a physical indicator, such as a mechanical or electromechanical indicator, or a video indicator displayed on a display device.

Figure 18:
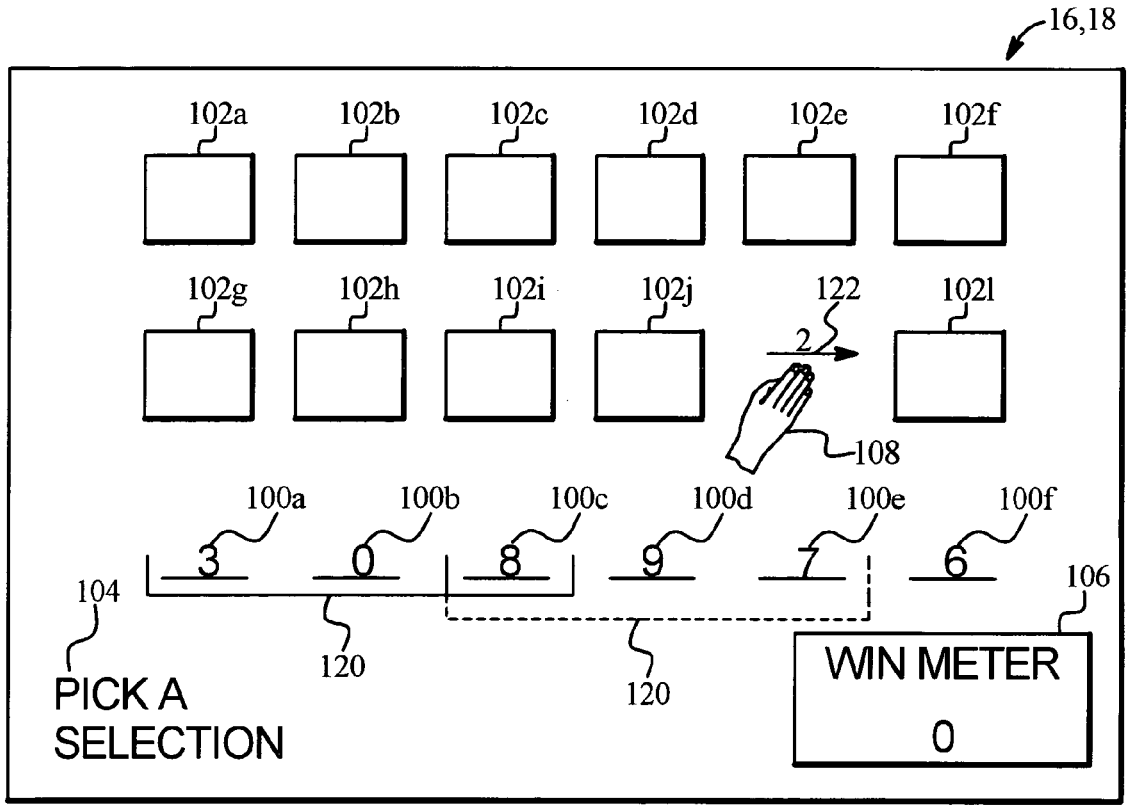
FIG. 18 is an elevation view of one of the display devices of the gaming machine showing an alternative embodiment of the game of the present disclosure.

In one such embodiment, as illustrated in FIG. 18, the movement of the moving indicator 120 is based on a selection game or sequence. In this embodiment, a plurality of selections are each associated with different movements amounts, such as "two positions to the right" or "three positions to the left". At least one selection is associated with a terminator. In operation of this embodiment, the player picks selections, one at a time, and based on the movement amount associated with the player picked selection, the moving indicator is shifted or moved the appropriate number of spots or positions along the string of numbers in the appropriate direction. This process continues until a terminator is selected, wherein when a terminator is revealed, the moving indicator's current position along the string of numbers determines the player's award or outcome which is provided to the player. For example, if a string of numbers including the numbers three, zero, eight, nine, seven and six are adjacently arranged and the player's picked selection reveals a "two positions to the right" movement amount 122 the moving indicator is shifted or moved from indicating the first three numbers (i.e., the numbers three, zero and eight) of the arranged string of numbers to indicate the third, fourth and fifth numbers of the arranged string of numbers. Accordingly, in this example, the shifting of the moving indicator modified the player's award or outcome from three-hundred-eight to eight-hundred-ninety-seven. In another embodiment, the gaming device randomly moves or shifts the moving indicator to any suitable position along the string of numbers to form different awards or outcomes.

In another embodiment, rather than numbers being moved off of or eliminated form the positions or digit places of the player's award or outcome, such numbers are accumulated in non-active digit spots. In this embodiment, the digit window may be shifted or modified to include one or more numbers accumulated in the non-active digit spots. In one embodiment, this accumulation forms the string of numbers described above. For example, if the number of numbers indicated by the moving indicator (described above) were increased by two, then two numbers previously accumulated in the non-active digit spots may be recaptured as part of the player's award or outcome.

In another embodiment, the gaming device stores, flags or tracks different multi-digit numbers or outcomes as they are formed during the play of the game. Upon a triggering event, one or more stored multi-digit numbers are subsequently regenerated for the player. For example, the gaming device stores the highest valued multi-digit number formed during the game sequence described above, wherein upon a suitable triggering event, the highest valued multi-digit number is regenerated and provided to the player as the player's award or outcome.

In another embodiment, each of the selections is associated with a number (i.e., none of the selections are associated with a terminator). In one such embodiment, the gaming device enables the player to pick selections until each of the selections is picked. In another such embodiment, the gaming device enables the player to pick selections until a designated number of selections are picked. In different embodiments, the designated number of selections are predetermined, randomly determined, determined based on the wager placed, determined based on the player's status (such as determined through a player tracking system), determined based on time, or determined based on any other suitable method.

It should be understood that various changes and modifications to the presently preferred embodiments described herein will be apparent to those skilled in the art. Such changes and modifications can be made without departing from the spirit and scope of the present disclosure and without diminishing its intended advantages. It is therefore intended that such changes and modifications be covered by the appended claims.

The invention is claimed as follows:

1. A gaming device operable under control of a processor, the gaming device comprising:

a display device;

an input device; and a memory device which stores a plurality of instructions, which when executed by the processor, cause the processor to operate with the input device and the display device to control a play of a game by:

(a) causing a pick of one of a plurality of unpicked selections;

(b) revealing if one of a plurality of numbers or one of at least one terminator is associated with the picked selection, wherein said plurality of numbers are individually associated with a plurality of the selections and each terminator is associated with one of the selections;

(c) if one of the numbers is revealed:

(i) determining one of a plurality of digit positions to place said revealed number, (ii) if said determined digit position is currently unoccupied, placing said revealed number at said determined unoccupied digit position, (iii) if said determined digit position is currently occupied by one of the numbers:

(1) moving said number to another digit position, wherein if the other digit position is currently occupied, the number at said other digit position is moved to another digit position, if any, or removed from said other digit position, and (2) placing said revealed number at said determined digit position, and (iv) repeating (a) to (c); and (d) if one of the terminators is revealed:

(i) providing the player an award based on the order of any numbers currently occupying the digit positions, and (ii) terminating the play of the game.

2. The gaming device of claim 1, wherein when executed by the processor, the plurality of instructions cause the processor to controls the play of the game by enabling the player to pick the selections.

3. The gaming device of claim 1, wherein when executed by the processor if one of the numbers is revealed, and each of the digit positions are currently occupied by one of the other numbers, the plurality of instructions cause the processor to control the play of the game by removing one of the other numbers from one of the digit positions.

4. The gaming device of claim 3, wherein the positions are arranged in a row and the removed number previously occupied one of the digit positions at an end of the row.

5. The gaming device of claim 3, wherein the digit positions are arranged as digits of the award and the removed number previously occupied a digit position corresponding to a highest order digit.

6. The gaming device of claim 1, wherein the terminator is associated with at least one additional function selected from the group consisting of providing: (i) at least one additional revealed selection; (ii) a number of additional credits; (iii) a multiplier that multiplies the award; (iv) at least one free game; (v) an option to have the numbers randomly rearranged in the positions; and (vi) a non-monetary award.

7. The gaming device of claim 1, wherein when executed by the processor if one of the terminators is revealed and less than a designated number of numbers currently occupy the digit positions, the plurality of instructions cause the processor to control the player of the game by providing a consolation award.

8. The gaming device of claim 1, wherein when executed by the processor if one of the terminators is revealed and less than a designated number of numbers currently occupy the digit positions, the plurality of instructions cause the processor to control the player of the game by providing a replay of the game.

9. The gaming device of claim 1, wherein at least one of the selections is associated with an anti-terminator.

10. The gaming device of claim 1, wherein when executed by the processor, the plurality of instructions cause the processor to control the play of the game by enabling the player to accept or reject the award based on the numbers currently occupying the digit positions.

11. The gaming device of claim 1, wherein at least one of the selections is associated with an award digit modifier.

12. The gaming device of claim 11, wherein when executed by the processor if said award digit modifier is associated with the picked selection, the plurality of instructions cause the processor to control the play of the game by modifying the number of digit positions.

13. The gaming device of claim 1, wherein at least one of the selections is associated with a shuffle modifier.

14. The gaming device of claim 13, wherein when executed by the processor if said shuffle modifier is associated with the picked selection, the plurality of instructions cause the processor to control the play of the game by modifying which revealed numbers are placed at which digit positions.

15. The gaming device of claim 1, wherein the digit positions are arranged in a plurality of levels.

16. The gaming device of claim 1, wherein for each occupied digit position which another number is moved to, when executed by the processor, the plurality of instructions cause the processor to control the play of the game by either moving the number at said occupied digit position to another digit position, if any, or removing the number at said occupied digit position from each of the digit positions.

17. A method of operating a gaming device, said method comprising:

(a) causing a pick of one of a plurality of selections;

(b) causing at least one processor to execute a plurality of instructions to operate with at least one display device to reveal if one of a plurality of numbers or a terminator is associated with the picked selection;

(c) if one of the numbers is revealed:

(i) causing the at least one processor to execute the plurality of instructions to determine one of a plurality of digit positions to place said revealed number, (ii) if said determined digit position is currently unoccupied, causing the at least one processor to execute the plurality of instructions to operate with the at least one display device to place said revealed number at said determined unoccupied digit position, (iii) if said determined digit position is currently occupied by one of the numbers:

(1) causing the at least one processor to execute the plurality of instructions to operate with the at least one display device to move said number to another digit position, wherein if the other digit position is currently occupied, the number at said other digit position is moved to another digit position, if any, or removed from said other digit position, and (2) causing the at least one processor to execute the plurality of instructions to operate with the at least one display device to place said revealed number at said determined digit position, and (iv) repeating (a) to (c); and (d) if said terminator is revealed:

(i) providing the player an award based on the order of any numbers currently occupying the digit positions, and (ii) causing the at least one processor to execute the plurality of instructions to terminate the play of the game.

18. The method of claim 17, which includes causing the at least one processor to execute the plurality of instructions to operate with at least one input device to enable the player to pick the selections.

19. The method of claim 17, which includes causing the at least one processor to execute the plurality of instructions to operate with the at least one display device to remove one of the other numbers from one of the digit positions if one of the numbers is revealed, and each of the digit positions are currently occupied by one of the other numbers.

20. The method of claim 19, wherein the positions are arranged in a row and the removed number previously occupied one of the digit positions at an end of the row.

21. The method of claim 19, wherein the digit positions are arranged as digits of the award and the removed number previously occupied a digit position corresponding to a highest order digit.

22. The method of claim 17, wherein the terminator is associated with at least one additional function selected from the group consisting of providing: (i) at least one additional revealed selection; (ii) a number of additional credits; (iii) a multiplier that multiplies the award; (iv) at least one free game; (v) an option to have the numbers randomly rearranged in the positions; and (vi) a non-monetary award.

23. The method of claim 17, which includes providing a consolation award if one of the terminators is revealed and less than a designated number of numbers currently occupy the digit positions.

24. The method of claim 17, which includes causing the at least one processor to execute the plurality of instructions to provide a replay of the game if one of the terminators is revealed and less than a designated number of numbers currently occupy the digit positions.

25. The method of claim 17, wherein at least one of the selections is associated with an anti-terminator.

26. The method of claim 17, which includes causing the at least one processor to execute the plurality of instructions to operate with at least one input device to enable the player to accept or reject the award based on the numbers currently occupying the digit positions.

27. The method of claim 17, wherein at least one of the selections is associated with an award digit modifier.

28. The gaming device of claim 27, which includes causing the at least one processor to execute the plurality of instructions to modify the number of digit positions if said award digit modifier is associated with the picked selection.

29. The method of claim 17, wherein at least one of the selections is associated with a shuffle modifier.

30. The method of claim 29, which includes causing the at least one processor to execute the plurality of instructions to modify which revealed numbers are placed at which digit positions if said shuffle modifier is associated with the picked selection.

31. The method of claim 17, wherein the digit positions are arranged in a plurality of levels.

32. The method of claim 17, which includes for each occupied digit position which another number is moved to, causing the at least one processor to execute the plurality of instructions to operate with the at least one display device to either move the number at said occupied digit position to another digit position, if any, or remove the number at said occupied digit position from each of the digit positions.

33. The method of claim 17, which is provided through a data network.

34. The method of claim 33, wherein the data network is an internet.

* * * * *

UNITED STATES PATENT AND TRADEMARK OFFICE

CERTIFICATE OF CORRECTION

PATENT NO. : 7,914,373 B2
APPLICATION NO. : 11/222914
DATED : March 29, 2011
INVENTOR(S) : Webb et al.

It is certified that error appears in the above-identified patent and that said Letters Patent is hereby corrected as shown below:

In Claim 2, Column 29, Line 60, replace “controls” with --control--.

In Claim 7, Column 30, Line 19, replace “player” with --play--.

In Claim 8, Column 30, Line 25, replace “player” with --play--.

Signed and Sealed this
Fourteenth Day of June, 2011

David J. Kappos

David J. Kappos
*Director of the United States Patent and Trademark Office*